US010228112B2

(12) United States Patent
Chien

(10) Patent No.: US 10,228,112 B2
(45) Date of Patent: Mar. 12, 2019

(54) LED AND/OR LASER LIGHT DEVICE HAS MORE THAN ONE OPTIC ELEMENTS AND WIDE FLAT OPENING OR SPHERE OUTER COVER TO CREATE BIG RANGE IMAGE OR LIGHTED PATTERN

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 15/296,599

(22) Filed: Oct. 18, 2016

(65) Prior Publication Data

US 2017/0038031 A1 Feb. 9, 2017

Related U.S. Application Data

(60) Continuation-in-part of application No. 14/503,647, filed on Oct. 1, 2014, now Pat. No. 9,719,654, which
(Continued)

(51) Int. Cl.

| | |
|---|---|
| ***F21V 14/00*** | (2018.01) |
| ***F21V 5/00*** | (2018.01) |
| ***F21V 7/00*** | (2006.01) |
| ***F21V 5/04*** | (2006.01) |
| ***F21S 8/00*** | (2006.01) |
| ***F21V 11/00*** | (2015.01) |
| ***F21V 23/06*** | (2006.01) |
| ***F21S 6/00*** | (2006.01) |
| ***F21V 21/14*** | (2006.01) |
| ***F21V 23/04*** | (2006.01) |
| ***F21S 10/06*** | (2006.01) |
| ***F21S 10/02*** | (2006.01) |
| ***F21K 9/60*** | (2016.01) |
| *F21Y 115/10* | (2016.01) |

(Continued)

(52) U.S. Cl.

CPC ..... *F21V 14/00* (2013.01); *F21K 9/60* (2016.08); *F21S 6/002* (2013.01); *F21S 8/035* (2013.01); *F21S 10/023* (2013.01); *F21S 10/063* (2013.01); *F21V 5/00* (2013.01); *F21V 5/04* (2013.01); *F21V 7/00* (2013.01); *F21V 11/00* (2013.01); *F21V 21/14* (2013.01); *F21V 23/0442* (2013.01); *F21V 23/06* (2013.01); *F21S 9/02* (2013.01); *F21Y 2113/10* (2016.08); *F21Y 2115/10* (2016.08)

(58) Field of Classification Search

None

See application file for complete search history.

(56) References Cited

U.S. PATENT DOCUMENTS

2006/0152946 A1* 7/2006 Chien ..... A61L 9/03 362/641

2008/0304289 A1* 12/2008 Chien ..... H04N 5/2354 362/641

(Continued)

*Primary Examiner* — Elmito Breval

(74) *Attorney, Agent, or Firm* — Bacon & Thomas, PLLC

(57) ABSTRACT

An LED and/or laser light device uses an outlet plug-in power source, bulb base power source, interchangeable power source, or USB power source, and incorporates more than one geometrically shaped optics elements or lens having reflective and/or refractive properties that cause a plurality of light beams to reflect, retro-reflect or refract before passing through the at least one optics lens to create or project an image, message, lighted pattern, number, time, geometric art, nature scene, etc. onto a desired surface with a wider viewing angle.

10 Claims, 12 Drawing Sheets

Related U.S. Application Data is a continuation-in-part of application No. 14/023,889, filed on Sep. 11, 2013, application No. 15/296,599, which is a continuation-in-part of application No. 14/983,993, filed on Dec. 30, 2015, now Pat. No. 9,909,739, which is a continuation-in-part of application No. 14/289,968, filed on May 29, 2014, now Pat. No. 9,551,477, which is a division of application No. 14/280,865, filed on May 19, 2014, now Pat. No. 9,581,299, which is a division of application No. 13/540,728, filed on Jul. 3, 2012, now Pat. No. 8,834,009, application No. 15/296,599, which is a continuation-in-part of application No. 14/606,642, filed on Jan. 27, 2015, which is a continuation-in-part of application No. 13/367,758, filed on Feb. 7, 2012, now Pat. No. 8,967,831, which is a continuation-in-part of application No. 13/296,508, filed on Nov. 15, 2011, now Pat. No. 8,562,158, and a continuation-in-part of application No. 13/296,469, filed on Nov. 15, 2011, now Pat. No. 8,711,216.

(51) Int. Cl.
*F21Y 113/10* (2016.01)
*F21S 9/02* (2006.01)

(56) References Cited

U.S. PATENT DOCUMENTS

2010/0213880 A1* 8/2010 Chien ..... G09F 9/33 315/317
2011/0110093 A1* 5/2011 Hsu ..... F21S 8/033 362/277

* cited by examiner

Fig 1-1
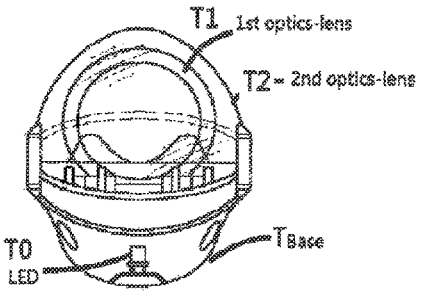
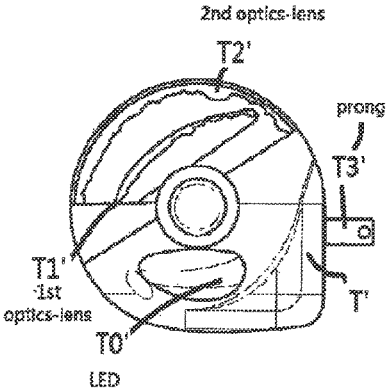
Fig 1-2
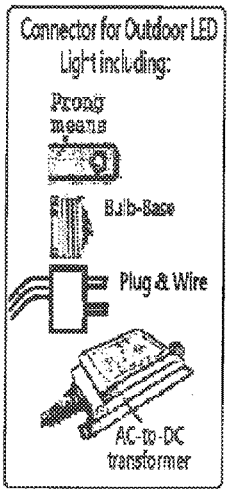
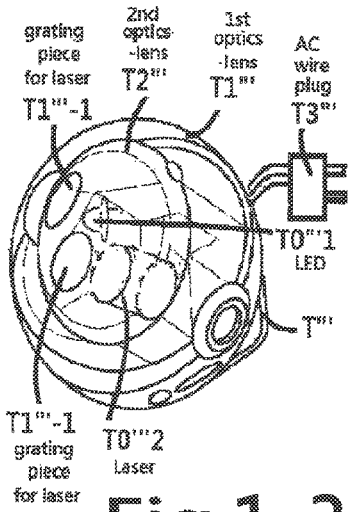
Fig 1-3
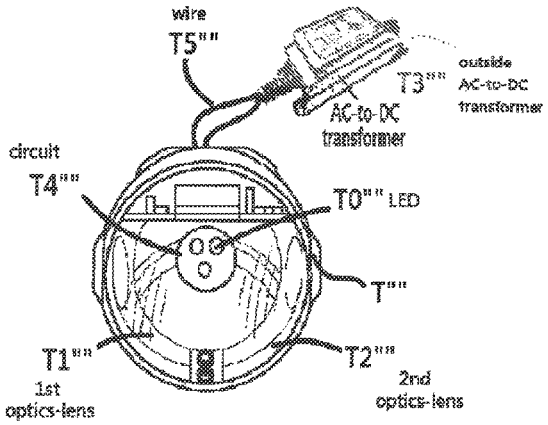
Fig 1-4

Laser Path
LED Path 3
LED Path 4
LED path 5
U2
LED path 2
U5
Gr
Ra
U3
LED Path 1
Rf
U-2nd
U3
U-1st
U4
U1
Housing of Night light
U6
Housing of Garden light
U7
U6-1
2. Prong power
3. USB Port
U7-1
power for Garden light
U8
Housing of LED Bulb
U8-1
1. Bulb Base or AC Power source
Connector for Outdoor LED Light including:
Bulb-Base
Plug & Wire
AC-to-DC transformer Fig.1-7
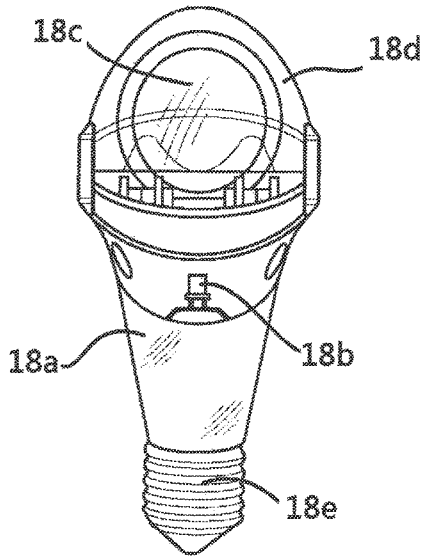
Fig. 1-8
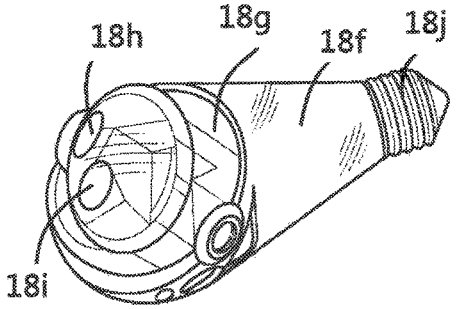
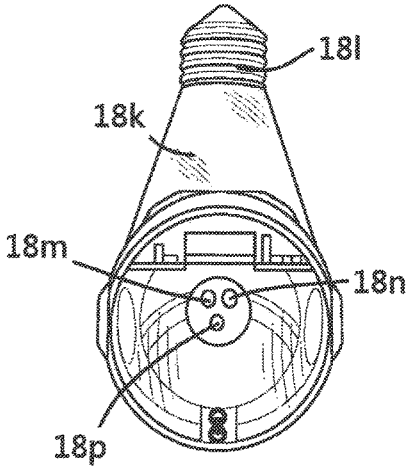
Fig.1-9
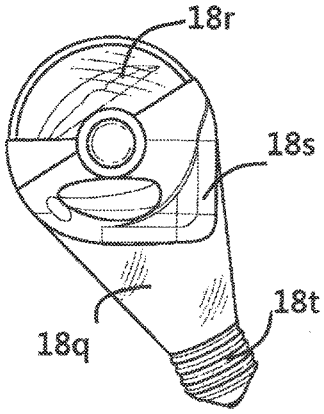
Fig. 1-10

Fig. 2
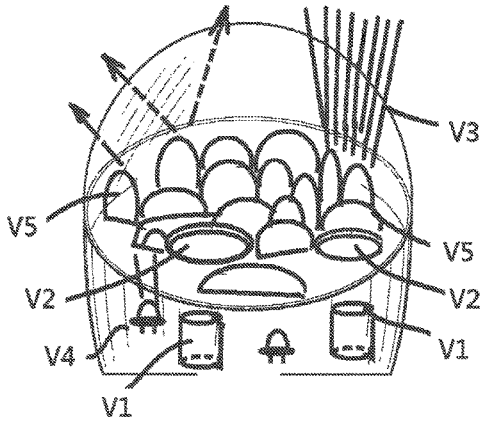
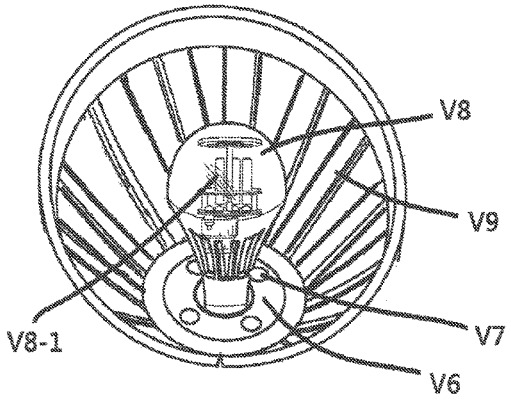
Fig. 2A

LED AND/OR LASER LIGHT DEVICE HAS MORE THAN ONE OPTIC ELEMENTS AND WIDE FLAT OPENING OR SPHERE OUTER COVER TO CREATE BIG RANGE IMAGE OR LIGHTED PATTERN

This application is a continuation-in-part of copending U.S. patent application Ser. No. 14/503,647, filed Oct. 1, 2014, Ser. No. 14/451,822, filed Aug. 5, 2014, and Ser. No. 14/323,318, filed Jul. 3, 2014.

This application is also a continuation-in-part of U.S. patent application Ser. No. 14/983,993, filed Dec. 30, 2015, and Ser. No. 14/289,968, filed May 29, 2014, which is a division of U.S. patent application Ser. No. 14/280,865, filed May 19, 2014, which is a division of U.S. patent application Ser. No. 13/540,728, filed Jul. 3, 2012, now U.S. Pat. No. 8,834,009.

This application is also a continuation-in-part of U.S. patent application Ser. No. 14/606,642, filed Dec. 30, 2015, which is a continuation-in-part of U.S. patent application Ser. No. 13/367,758, filed Feb. 7, 2012, now U.S. Pat. No. 8,967,831, which is a continuation-in-part of U.S. patent application Ser. No. 13/296,508, filed Nov. 15, 2011, now U.S. Pat. No. 8,562,158, and Ser. No. 13/296,469, filed Nov. 15, 2011, now U.S. Pat. No. 8,711,216.

BACKGROUND OF THE INVENTION

In the U.S. market, there are a lot of desk top items with bulky shapes and large sizes. These items often have optic elements and motor mechanics to show and project images or any information towards a wall or ceiling. However, all of these items are overpriced and not technically compact enough to be a good item in this market. Also, they are powered by limited power batteries that only offer a short using time.

The current invention is designed provide improved LED lights and/or laser light devices for projecting, showing, or creating an image(s), message(s), number(s), time, geometric art(s), nature scene(s), galaxy(ies), milky way, sky(ies), cloud(s), space nebula, stars, moon, water-wave(s), aurora light(s), animal(s), character(s), cartoon(s), sign(s), logo(s), or commercial(s) with extra-small size and weight to allow users to be able to plug the LED lights and/or laser light device into any wall or ceiling outlets, extension cords, power strips, or USB power sources, or to be screwed inside a bulb base.

Connection directly to a plug-in outlet or USB port or bulb base is easy, and eliminates any need for the user to have to handle ACwiring, adaptors with wires, or transformers with wires, are very difficult to handle and can cause people to fall down or due to electric-shock for indoor application. As a result, the current invention for indoor light application preferably does not use wired arrangements or batteries that limit running hours and are too risky for desk top installation, in contrast to for outdoor light application the preferred outlet, or plug-in prong or AC plug-wire or USB or bulb base arrangements. Also, the current invention concerning the user's safety, this invention for indoor application is preferred to be designed No wired design because for indoor wire. management can either be too clumsy to manage and keep neat or too dangerous because the wires can cause the user to fall down by tripping on the wires. The outdoor light application preferred process of using this product to plug prong or AC plug on additional power options such as extension cords will work perfectly for AC Plug-wire to plug-in outlet(s).

Because the invention is designed to be used with USBs, bulb bases, or plug prong or AC plug into outlets, it has the advantage of providing effectively unlimited power, unlike anything on the market which operates under the power of batteries or alkaline batteries.

The invention can utilize a moving or changeable optic element (such as a stencil or optic-lens) incorporated with other optics-elements (including optics lenses) with changeable color, duration, function, and duty cycles, and an LED(s) and/or laser light source to make the LED or Laser light device become more than just a single optics-elements device, thereby increasing the LED(s) and/and/or laser-light(s) performance, effect, and functions including color change, size change, motion, and moving images or lighted patterns, as well as all other light functions and performance available from the marketplace in all combinations. Some preferred embodiments below will have 3, 4, 5 or more optics elements to form a splendid light show.

This invention may uses a traditional items, such as a rotating device, motor, inductive device (having a magnet and magnetic-coil assembly), or silent clock movement to move the optical elements (with or without the optics lens) and/or light sources and provide effects such as moving and projecting an image(s), message(s), number(s), time, geometric art(s), nature scene(s), galaxy(ies), milky way, sky(ies), cloud(s), space nebula, stars, moon, water-wave(s), aurora light(s), animal(s), character(s), cartoon(s), sign(s), logo(s), or commercial(s). This invention is designed to have multiple optical elements (with or without the optics lens) to cooperate with the rotating device, motor or movement to create or to show a movable or changeable, colorful, and splendid image of lighted patterns and/or projection.

Furthermore, the current invention may use an alternative design to create the moving or variable or changeable light effects, which has no need to use a motor, rotating mechanism, or magnet and magnetic-coil assembly, which is an important improvement with respect to cost considerations. The alternative design is for the LED and/and/or laser-light to have changeable light functions with different timing for different functions, to achieve the effect of a changeable image, message, time, geometric art, nature scene, galaxy, milky way, sky, cloud, starts, moon, water waves, animal, characters, cartoon, sign, logo, or commercial.

This invention also can use alternative ways to create splendid image(s), message(s), number(s), time, geometric art(s), nature scene(s), galaxy(ies), milky way, sky(ies), cloud(s), space nebula, stars, moon, water-wave(s), aurora light(s), animal(s), character(s), cartoon(s), sign(s), logo(s), or commercial(s) by not using an inner-layer optical lens, and instead using an optics-element (but not a lens) with holes, stencils, walls, openings, or cutouts and that is incorporated with a movable device to project or show a different effect than an optics lens or convex optical lens would show.

The current invention offers a big improvement when all moving or motion effects are made by a plurality of LEDs' and/or lasers' sequential flashing, fade-in and fade-out, color changing, random flashing, or other light performances, effects, durations and uses in which LEDs and/or laser light sources at different locations or orientations have different turn-on and turn-off times, durations, or duty cycles to cause an image or pattern to appear to be moving.

One big improvement of this invention is the use of different sequential patterns for the LED lights and/or laser lights, such as fade-in and fade-out, flashing, color-changing, sequential, random, breathing, waves, etc., which are accompanied by another programming of time, duration, on-off duty cycle, day, time, orientation, location, and/or other cycling controlled by an IC chip or elements to cause the projected image to have moving or changeable colors, patterns, size, and effects.

More advanced improvements in the shaped image, message, time, geometric art, nature scene, galaxy, milky way, sky, cloud, starts, moon, water-wave, aurora light, animal, characters, cartoon, sign, logo, or commercial can easily be obtained from at least one or more than one optics element (with or without an optic-lens) having a preferred texture, opening, cutouts, holes, or shape and incorporated with refractive optics to enable broad areas to be seen when illuminated by at least one LED and/or laser-lights' beam with rotating or non-rotating means to provide the desired moon, stars, or moving aurora effects.

The invention can have a variety of different image(s), message(s), number(s), time, geometric art(s), nature scene(s), galaxy(ies), milky way, sky(ies), cloud(s), space nebula, stars, moon, water-wave(s), aurora light(s), animal(s), character(s), cartoon(s), sign(s), logo(s), or commercial(s) due to the free ability to mix and match the optics-lenses from other optics-elements, including second optics lenses, having holes, stencils, walls, openings, or cutouts.

The current invention may use principles disclosed in the inventor's copending and issued patent applications, including U.S. patent application Ser. No. 14/024,229 (LED light has kaleidoscope means), Ser. No. 13/021,124 (LED light has changeable image and pattern by kaleidoscope means to project to surfaces), Ser. No. 12/710,918 (LED light has more than one reflector means), now U.S. Pat. No. 8,827,087, which like the current invention may apply kaleidoscope means having more than one reflective means such as mirrors or mirror-like means assembled into the kaleidoscope means, and Ser. No. 11/806,284 (LED light has more than one optic means), now U.S. Pat. No. 7,632,004, which has use more than one optics means and, like the current invention, may apply the optics means in front of or in back of the kaleidoscope means to create, adjust, magnify, reduce, or enlarge an image, LED light beams, an LED lights' image, or shape and which includes any combination of one or more optics lens, optics mirror, laser hologram, laser grating film, or optics assembly.

The inventor's U.S. Pat. No. 7,455,444 discloses an LED light having more than one LED light source. The current invention also can use more than one LED for matrix arrangements with circuit means, IC means, sensor means, switch means, brightness control means, color mix means, color selection means, color freeze means, motor means, gear means, turn-on and turn-off means to cause a certain number of LEDs to turn-on with desired color and brightness, a light brightness output, light functions, matrix combinations, motor means, rotating means, gear set means, kaleidoscope means, optics means, and/or laser means to obtain desired light patterns.

Other LED light devices are disclosed in the inventor's U.S. patent application Ser. Nos. 12/948,953, 12/938,564 12/886,832, 12/876,507, 12/771,003, 12/624,621, 12/914,584, 12/318,471, 12/318,470, and Ser. No. 12/834,435, and U.S. Pat. Nos. 7,871,192, 7,832,917, 7,832,918, 8,303,150, 8,408,736, and 8,083,377, While projection lights are described in the inventor's U.S. patent application Ser. Nos. 12/886,832, 12/938,564, 12/948,953, and 13/021,107.

In addition to the above, the inventor has patent applications and patents for a light device having interchangeable AC and DC power sources for wall outlets and energy storage means, including any of prong means, an extension cord, adaptor, transformer, solar, wind power, batteries, chemical power, biological power, all of which can be used by the projection light device having built-in kaleidoscope means of the current invention. The inventor's interchangeable power source applications and patents include U.S. patent application Ser. Nos. 12/318,473 and 12/940,255 (now U.S. Pat. No. 8,231,246. The current invention can make use of the features disclosed in any of the above-listed patent applications or patents of the inventor, including: (1) projection light device features, (2) more than one optics means, (3) more than one LED, (4) more than one reflective means, (5) interchangeable power sources, (6) laser means, (7) adjustable focus and position change mechanisms, and (8) motor and gear sets for adjustable movement.

This application also may have subject matter in common with the inventor's U.S. patent application Ser. Nos. 12/710,561; 12/711,456; 12/771,003; 12/624,621; 12/622,100; 12/318,471; 12/318,470; 12/318,473; 12/292,153; 12/232,505; 12/232,035; 12/149,963; 12/149,964; 12/073,095; 12/073,889; 12/007,076; 12/003,691; 12/003,809; 11/806,711; 11/806,285; 11/806,284; 11/566,322; 11/527,628; 11/527,629; 11/498,874; 12/545,992; 12/806,711; 12/806,285; 12/806,284; 12/566,322; 12/527,628; 12/527,629; 12/527,631; 12/502,661; 11/498,881; 11/255,981; 11/184,771; 11/152,063; 11/094,215; 11/092,742; 11/092,741; 11/094,156, 11/094,155, 10/954,189; 10/902,123, 10/883,719; 10/883,747; 10/341,519; 12/545,992; and Ser. No. 12/292,580.

In particular, the following applications show light devices that have at least some features in common with included or optional features of the LED light device of the present invention: Ser. No. 12/710,561 ("LED power failure Light"); Ser. No. 12/711,456 ("LED light device has special effects"); Ser. No. 12/771,003 ("LED light device has more than 1 reflective means for plurality of image"); Ser. No. 12/624,621 ("projection device or assembly for variety of LED light"); Ser. No. 12/622,000 ("Interchangeable Universal Kits for all LED light"); Ser. No. 12/318,471 ("LED night light with pinhole imaging"); Ser. No. 12/318,470 ("LED night light with Projection features"); Ser. No. 12/318,473 ("LED night light with laser or hologram element"); Ser. No. 12/292,153 ("LED night light with Projection or imaging features"); Ser. No. 12/232,505 ("LED night light with Projection features"); Ser. No. 12/149,963 ("Removable LED light device"); Ser. No. 12/149,964 ("Surface Mounted Device with LED light"); Ser. No. 12/073,095 ("LED Track light device"); Ser. No. 12/073,889 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/806,285 ("LED Night light with outlet device"); Ser. No. 11/806,284 ("LED Night light with more than 1 optics means"); Ser. No. 11/527,628 ("Multiple function Night light with air freshener"); Ser. No. 11/527,629 ("LED Night light with interchangeable display unit"); Ser. No. 11/498,874 ("Area illumination Night light"); Ser. No. 11/527,631 ("LED Time piece night light"); Ser. No. 12/545,992 ("LED time piece Night light"); Ser. No. 12/292,580 ("LED Time Piece Night light"); Ser. No. 11/498,881 ("Poly Night light"); Ser. No. 11/255,981 ("Multiple light source Night Light"); Ser. No. 11/184,771 ("Light Device with EL elements"); Ser. No. 11/152,063 ("Outlet adaptor with EL"); Ser. No. 11/094,215 ("LED night light with liquid medium"); Ser. No. 11/094,215 ("LED Night light with Liquid optics medium"); Ser. No. 11/092,741 ("Night light with fiber optics"); Ser. No. 10/883,747 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285 ("LED Night Light with multiple function"); and Ser. No. 11/806,711 ("Multiple LEDs Light with adjustable angle function").

A preferred embodiment of the current invention includes an LED or laser light having more than one optics means and each of optics means has transparent, reflective and/or refractive means within the geometric shape of the optics means that allows a plurality of light beams to pass through or reflect and/and/or refract within the more than one reflector and/and/or refractive means inside the optics means.

The LED and/or laser-light device includes at least one LED and/or laser-light arranged on the inside of a geometric housing having more than one reflective and/or refractive optics-lens, and at least one second optics-element, which may be a second optics-lens within the geometric optics assembly that can reflect or refract light beams from the LED(s) and/or laser-light(s) to the first optics-elements (which may be optic-lenses having reflective and/or refractive surface(s) on front and back surfaces), so that some light beams are reflected and/or refracted and/or travel within the first optics-element(s) and other light beams pass through the partially transparent optics means to the second optics-lens having refraction properties and cause the light beams to be emitted to outside and create a big range of viewing angles or cover big areas.

The LEDs and/or laser-light(s) of these embodiment are preferably connected with a circuit, power source, contact kit, conductive kit, switch, sensor, motor, movement, magnetic unit and coil assembly, spin mechanism, rotating kit, gear set, speed controller, printed circuit, integrated circuit (I.C.) and/or related parts and accessories to cause the LEDs and/or laser-light(s) to turn on and off according to a predetermined time period, functions, colors, and/or effects to provide a desired lighting performance.

In the above-described preferred embodiment, the reflective and/or refractive optics-lens may be a mirror-like polished surface, optics lens, convex lens, concave lens, optics properties lens, chrome finished piece, polished piece, double-side mirror, or any surface in desired size, shape, thickness, focus, wide viewing angle which has reflective or refractive properties to allow light beams to travel or pass through both or more than one of a suitable optics lens.

The partial transparent, see-though properties and reflective or refractive features can be provided by a transparent piece, colored transparent piece, or any other pieces that allow light beams to pass there through or be reflected or refracted. A power source of those embodiment can be in the form of an outlet, batteries, solar power, chemical power, or wind power by proper connect at least for prong or Bulb-Base or USB means.

The LEDs and/or laser-light(s) can be selected from any combination of single color, multiple colors, multiple pieces, standard, special assemblies, and/or LEDs and laser-light numbers from 1 to N (N can be any number) to arrange in and desired matrix, order, or combination with proper spacing.

Finally, the distance, position, orientation of the reflective or refractive optics-lens may be changed with respect to the LED(s) or laser-light(s). The LED or laser-light arrangement have different LED or laser-light numbers, positions, colors, IC chips, controllers, circuits, functions, and brightnesses and may be selected to incorporate motor/movement/spinning/rotating/magnet and coil assemblies to create a desired plurality of light patterns, shows, color changing, image changing, and moving effects that can be viewed by people on one or more surfaces including walls, ceilings, floors, or other desired surfaces.

The geometric optic lenses can have any desired shape with multiple constructions having different effects, and can have any desired combination selected from a transparent lens, reflective lens, convex lens, concave lens, laser lens, hologram lens, and lenses with desired focus, thickness, variable thickness, plurality of optics means, wave texture, desired texture, curvature, and/or optics properties on the inner optical element and/or on the outer optical element and/or on all sides of the surfaces to provide predetermined and desired lighting effects or projection or effects.

From all the details above, those skilled in the art will understand that this invention has more than one built in reflective or refractive optical lens or element, and uses the more than one geometrically shaped optical lens or element to multiple LED and/or laser light beams to pass through, reflect, retro-reflect, or refract, the optical lens(es) or element(s) selectively being incorporated with other electric parts and/or accessories to project, create, or show a wider viewing angle image projection and/or image. The relative distance, position and/or orientation of the optical lens(es) or element(s) with respect to the light source (or any additional elements of the light source) will result in different light beam performances. This invention thus provides a simple way to make a splendid, eye-catching, beautiful light show, performance, projection, and creation with a wide viewing angle to cover a huge area, ceiling, wall, or any other surfaces. The other reason this invention is convenient to use is the invention will operate under multiple commonly used power sources: USB power, outlet (prongs) power source, generator power, chemical power, solar power, magnetic power, wind power, and especially power supplied through a bulb base, etc.

BRIEF DESCRIPTION OF THE DRAWINGS

As shown in FIG. 2A, this embodiment also may have third optics-elements such as hexagons, a core, or ball with many cut surfaces to allow the bottom LED and/or laser light beams to pass through so that a plurality of light beams hit the dish like reflectors to get splendid light effects with or without a moving or motor device to create moving effects. Each of the optics-elements has predetermined optics properties to allow LED and/or laser light beams to be emitted out to a big area or wider viewing angle.

FIGS. 1-1, 1-2, 1-3, 1-4, and 1-5 show details of the first preferred embodiment with two major optics-elements. FIG. 1-1 also shows that the first preferred embodiment may incorporate a USB female port while prong terminals are shown in FIGS. 1-2, 1-3, and 1-4.

FIGS. 1-6, 1-7, 1-8, 1-9, and 1-10 show an alternative embodiment which uses different terminals to connect to different power sources, such as bulb base terminals to deliver AC power into a bulb-base for bulb-like LED and/or laser light products, prong terminals to supply AC power, and/or USB female ports to supply DC power to a product having the shape of the first preferred embodiment.

FIGS. 2-1, 2-2, 2-3, 2-4, 2-5, and 2-6 show details of a second preferred embodiment FIGS. 3-1 and 3-2 show a third preferred embodiment FIGS. 4, 4-1, and 4-2 show a ½ ball, ⅔ ball, sphere or dome top cover optic-lens having multiple small size reflective-surfaces inside the ball and multiple small size refractive-surfaces on the outside surface to form optic-elements having more than one optics-property.

DETAILED DESCRIPTION OF THE PREFERRED EMBODIMENTS

Figure 1:
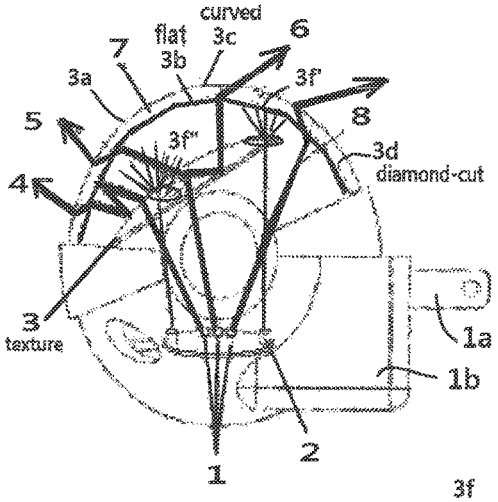
FIG. 1 shows a first preferred embodiment of an LED and/or laser light device having more than one optics-element including a first optics element in the form of an outer half ball, ⅔ ball, dome, or sphere shaped optics-lens and an inner geometrically shaped second optics-element which is another optics lens. Both optics elements have predetermined optics properties that allow LED or laser light beams to be emitted out to a big area or wider viewing angle.

From FIG. 1 original filed text box: Preferred #1

More than one of reflect or 0 and refract optics elements to create wide viewing angle light effects. Preferred 1:

1. LED and/or laser(s)
2. Outside sphere optics element
3. Inner optics lens both sphere and inner lens has desired texture, thickness, wave shape to get the light beam traveling or passing though by both reflective or-and refractive properties to create wide image.

Figure 1A:
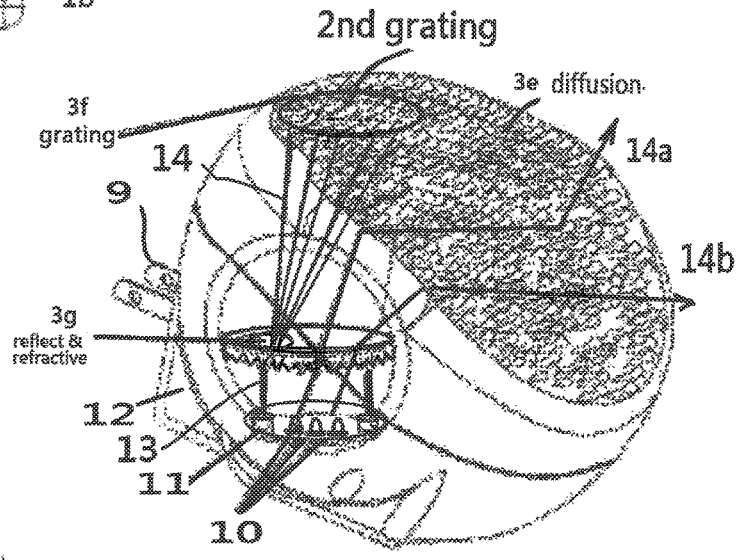
FIG. 1A shows a second preferred embodiment of an LED and/or laser light device having more than one optics-elements in which an outer cover with a flattened wider opening cover forming an optics lens is the first optics-element and in which the second optics element is an inner geometrically shaped optics-element which is not an optics lens but is made of a preferred material and which may be a plastic film, slide, film, printed sheet, image-forming carrier, shape-forming carrier, color film, and/or a piece having openings, cutouts, windows or printed shapes to make the LED and/or laser beams pass through non-block areas and shape the light beam. The second inner optics-element can work with a moving device to make the image or lighted patterns have moving, changeable effects. Both optics elements have pre-determined optics properties to allow LED and/or laser light beams to be emitted out to a big area or wider viewing angle.

From FIG. 1A original filed text box: Preferred #2

1. LEDs and or laser(s) has function
2. Outside wide angle cover has optics texture
3. Inner LED's cover with wave texture, variable thickness, moving by motion/motor/magnetic & coil system;

Both covers has reflective or-and refractive properties so can make light beams traveling or passing through to create wide viewing angle image include water wave, aurora, galaxy, silver river, moving clouded by colorful LEDs with different time for on-off and duration or cycles or time period.

Figure 1B:
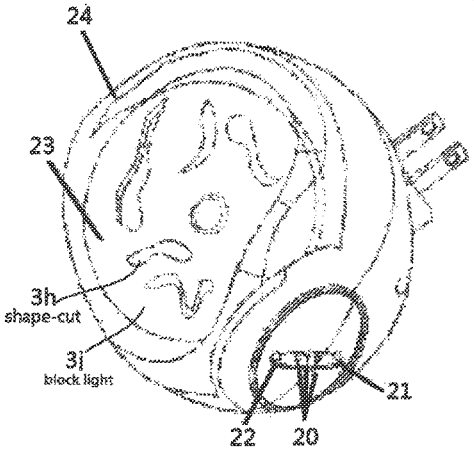
FIG. 1B shows a third preferred embodiment of an LED and/or laser light device having more than one optics-elements in which the first optics element is a cover with a flat wider opening including an optics-lens and the second optics element is an inner geometrically shaped optics-element which is not an optics lens but is made of a preferred material and which may be a plastic film, slide, film, printed sheet, image-forming carrier, shape-forming carrier, color film, and/or piece having openings, cutouts, windows, or printed shapes through which the LED and/or laser beams pass to shape the light beams.

From FIG. 1B Original filed text Box: Prefer #3.

1. Colorful LEDs and/or laser(s) has functions
2. Outside wide angle cover has optics textures
3. Top inner light block-item has geometric window, holes, cutouts, stencil to form shape image
4. 4. Lower inner optics-element has all kind of different shaped thickness optic-lens;

All (3) optics-elements to cause the light beam traveling or passing through from LEDs to lower or inner piece to become different angle, size, brightness light beams through the top optics cover to form designed shaped image or close nature scene may including aurora, water wave, galaxy, silver river, sky, clouds may has motor/gear set/spin/movement/magnetic & coil to make the moving/motion/effects, functions, image.

FIGS. 1, 1A, and 1B show preferred embodiments of the current invention having prongs and more than one optics element to create a wide viewing angle image. All of these embodiments have common parts including (1) a light source with LEDs or laser-lights, (2) a wider angle top cover (preferably an optics-lens having refractive functions) with preferred optic properties, (3) more than one optics element including at least one inner first optics element each having light passing or light shaping and/or reflective or refractive functions built-in, (4) each optics element having predetermined optics properties resulting from a different size, shape, thickness, variable thickness, height, cutout, stencil, window, silkscreen, or other assortment, arrangement, or combination of optics-elements, which may include a convex-lens, concave lens, or reflective tiny pieces, (5) the optics elements or light source (LEDs and/or laser-light) may be incorporated with motor/spinning/rotating/movement/magnet and coil assemblies to make the optical elements or light source to become moving optical-element(s) or light sources to create a splendid light performance that has a changeable image, lighted patterns, message, time, geometric art, nature scene, galaxy, milky way, sky, cloud, starts, mom, water waves, animal, characters, cartoon, sign, logo, and/or commercial.

As shown in FIGS. 1, 1A, and 1B, an LED and/or laser-light device which has more than one optical element(s) including optics-lens(es) with reflective or refractive properties. These devices have plug-in type prongs to connect with outlets from a wall, an extension cord, a power station, or a desk lamp power station's outlet receptacle. The LED and/or laser light device projects the light images towards ceilings, walls, floors, the ground, and any other preferably flat and visible area. The top cover of the device has a designated, waved, diffusion or refraction treatment with preferred thickness, and is able to project and project the images and/or lighted patterns while widening them to cover a bigger space, area, or location.

The optics-elements may include but are not limited to an optics-lens which has convex, reflective, refractive or any combination of optics properties and constructions as needed. Hence, in the current invention, any light beam can travel or pass through more than one geometrically shaped optics-element such that a light beam emitted out from an LED and/or laser-light will hit the first reflective or refractive optics-lens or other optics-element(s), and then hit second, third, fourth, and/or additional optics elements until the light beam passes to the outside through the top cover optics-elements, which preferably is an optic-lens with refraction properties.

Any number of optics elements may be provided and the optics element can be an optic lens or be made of any kind of material that will change the direction or path of light coming from the LEDs and/or laser. The optical lens can be a convex lens with designed thickness or a reflective/refractive lens to increase light effects and be incorporated with a moving device to make movement patterns of the lights, and the lenses are not limited to one type of lens, but can be used in any combination of market available optics-lenses with different optics properties.

As shown in FIG. 1, the more than one optics-element(s) include a top cover in the form of an optics-lens and inner optics-elements that are also optics-lenses with desired lens specifications and optics properties. Thus, the first embodiment has two optics-elements that are both optics-lenses. The top cover optic-lens has textures or variations, or variable thickness reflective and/or refractive designs to make all incoming light beams reflect and/or refract as they travel or pass through the top cover optics-lens to widen the viewing area. The light beams emitted from the LEDs and/or laser-lights having selected numbers, colors and brightnesses may be multiply refracted and/or refracted to get very splendid color, light spot, diffusion, and variable pattern effects, and when incorporated with an IC or movement device or motion unit, can provide light effects with movement and color changing for especially exciting effects.

In the embodiment shown in FIG. 1A, the more than one optics-element not only includes the top cover optics-lens with textures such as the preferred wave textures, but also an inner second optics-element that is not an optics-lens but rather is made of another preferred material with desired treatments, such as a printed film, stencil, or plastic sheet having an opening, cutouts, shapes or windows and that can be incorporated with a movable, shakable, waving, rotating, and/or spin device to cause light beams from a non-movable light source that includes LEDs and/or laser-lights to pass through the movable second optics-elements and its optics designs such as textures or wave shapes and then through the first optics-lens after multiple reflections and/or refractions to get the desired light effects after the light beams come out from the top cover optics-lens. The example is for two optics-elements, one of which is an optic lens that serves as top cover and the other of which includes optics elements made of another material and having a preferred shape, film, slide, pre-shaped window, printed film, or image-forming carrier on the optics-element to form a desired shape, image, characters, sign, slogan, or words. The light beams coming out of the second optics-elements incorporated with a moving device will exhibit moving effects and then hit the first top cover optics-lens and its texture or optics designs will cause multiple reflections and/or refractions to achieve a light performance with moving wave effects, or effects such as an aurora, moving clouds, changeable galaxy, moving stars, moving milky way or other nature scenes whose details result from the design of the inner second optics-elements with design-forming carrier or image-forming carrier, and which may include a film, slide, LCD display, stencil, printed film, etc.

Figures 1, 2, 3, 4, 5:
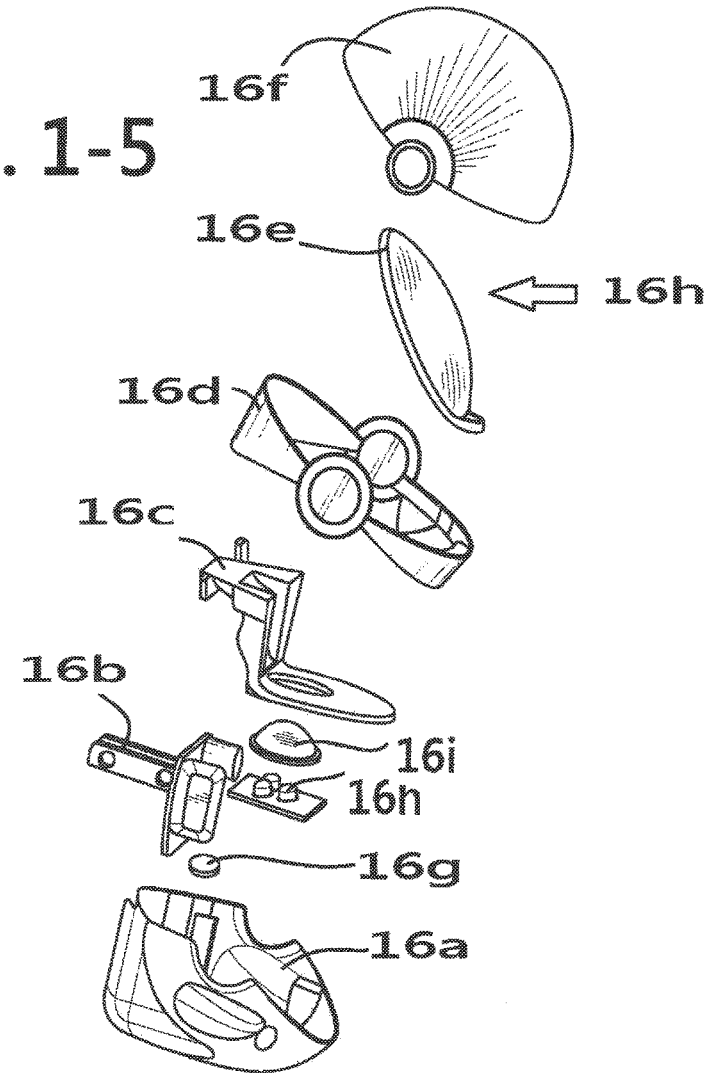
Figures 1, 2, 3, 4, 5, 6:
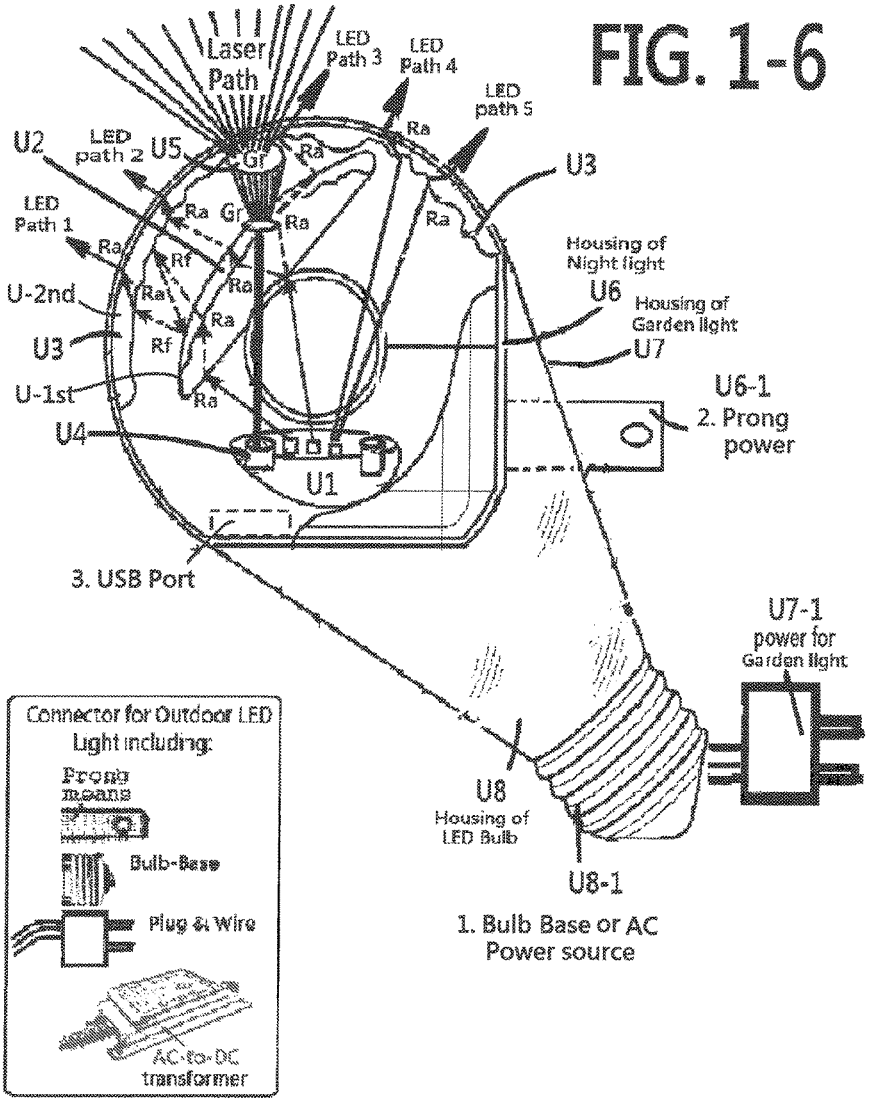
Figures 1, 2:
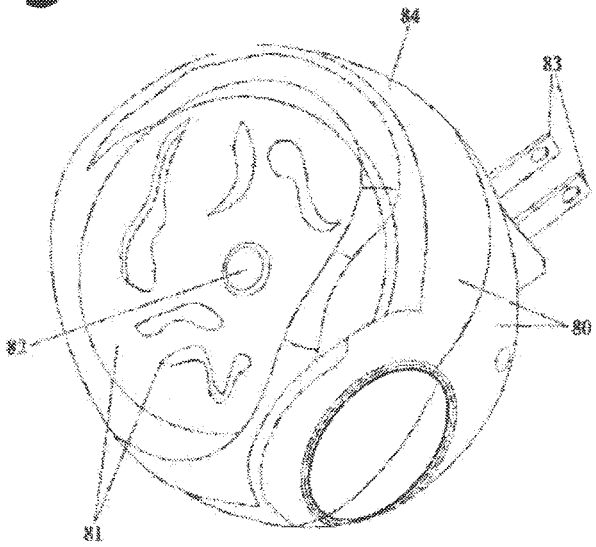
FIGS. 2 or and 2A show second optics-elements in the form of dish-like reflectors having a plurality of small or tiny reflectors built-into the dish like surface. The second inner optics-element can work with a moving device to cause the image or lighted patterns to have moving, changeable effects.
Figure 2:
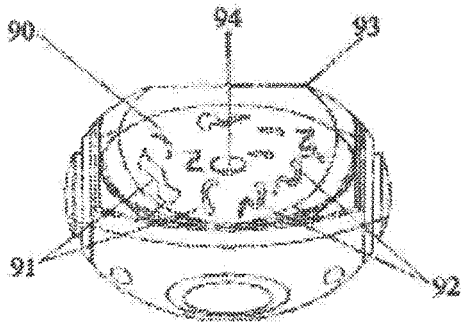
Figures 2, 3:
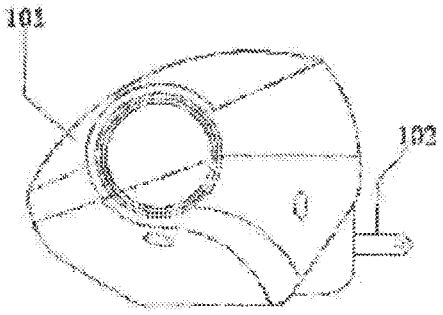
Figures 2, 3, 4:
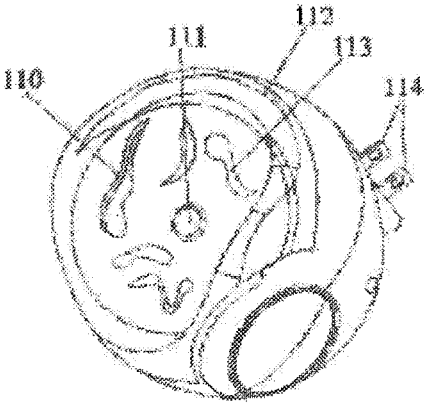
Figures 2, 3, 4, 5:
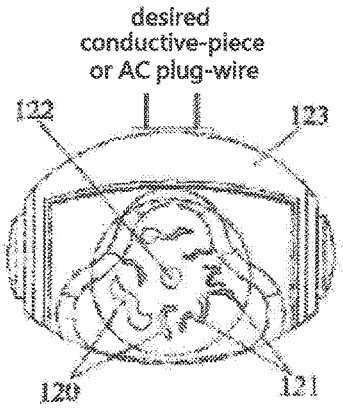
Figures 2, 3, 4, 5, 6:
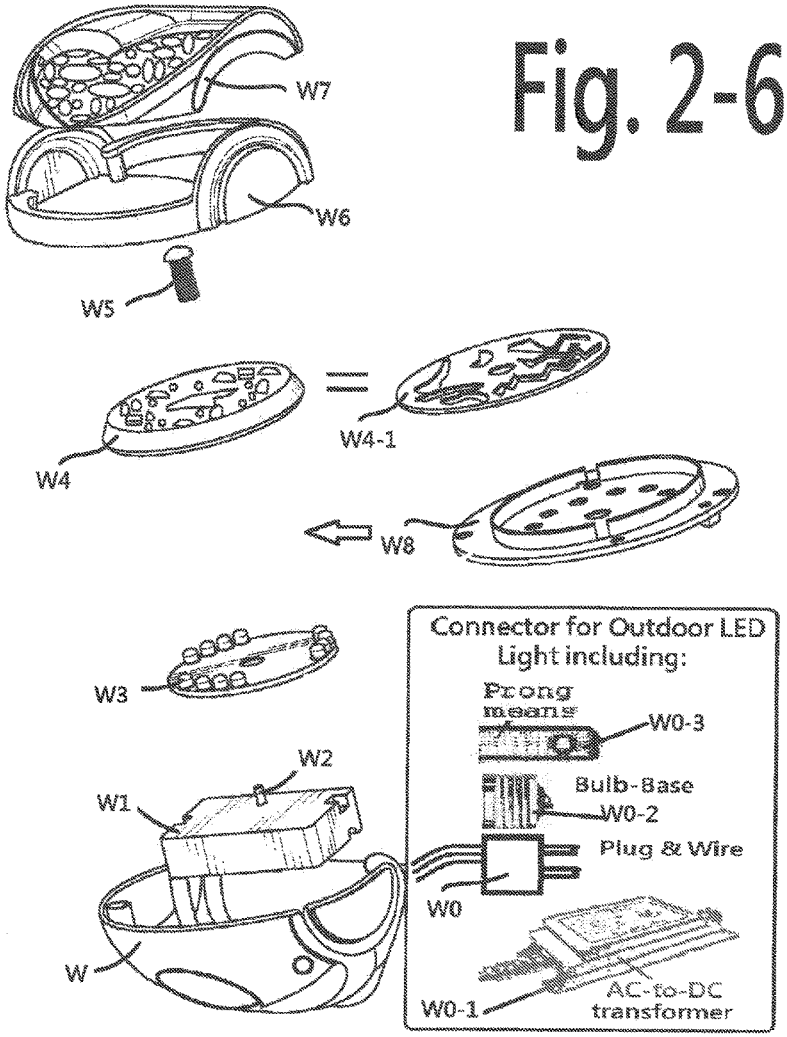
Figures 1, 3:
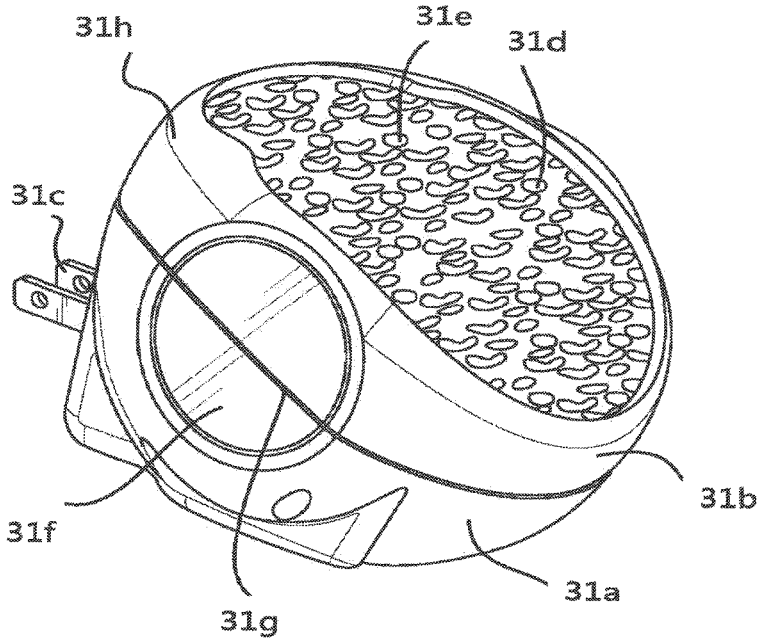
Figures 2, 3:
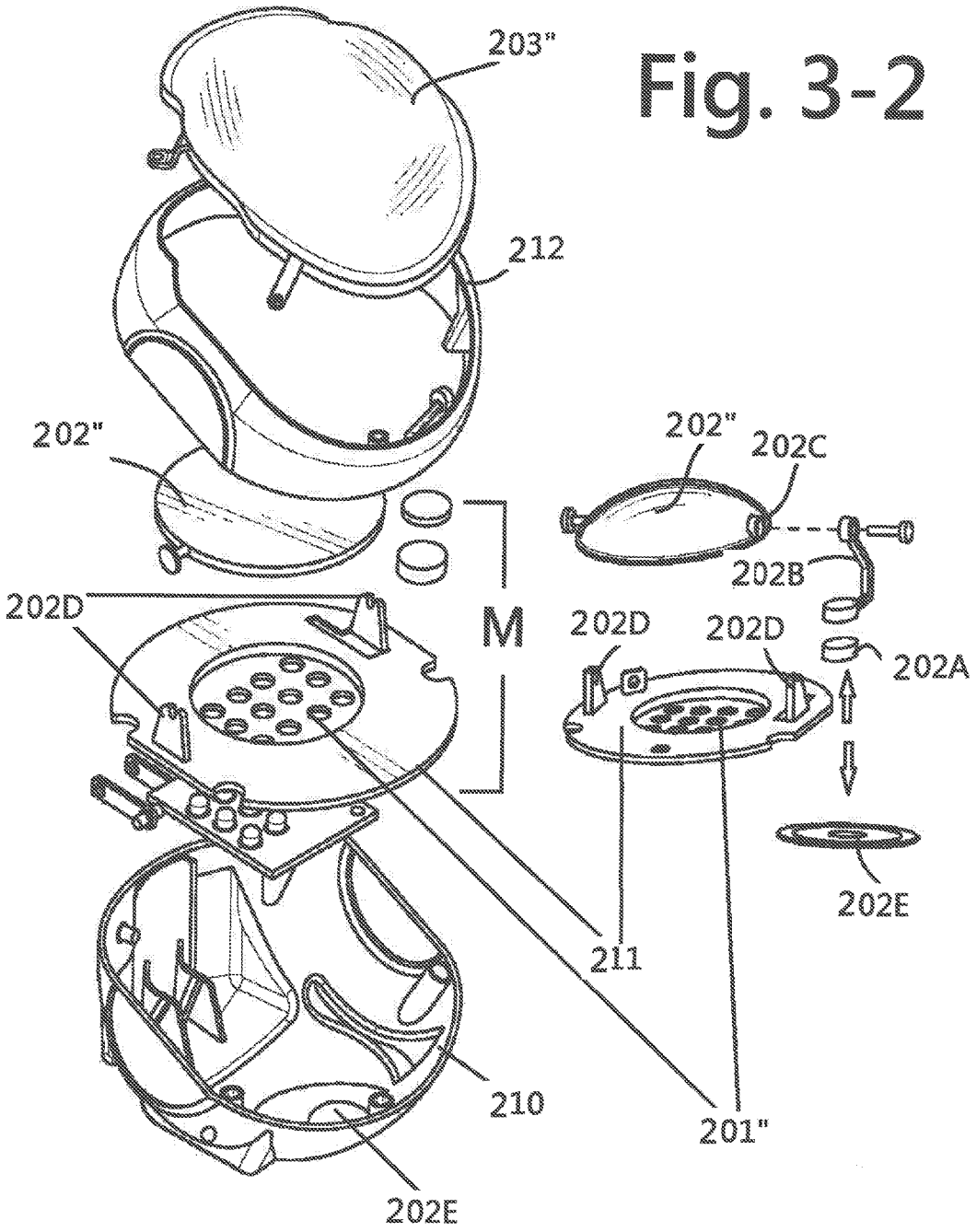
Figure 4:
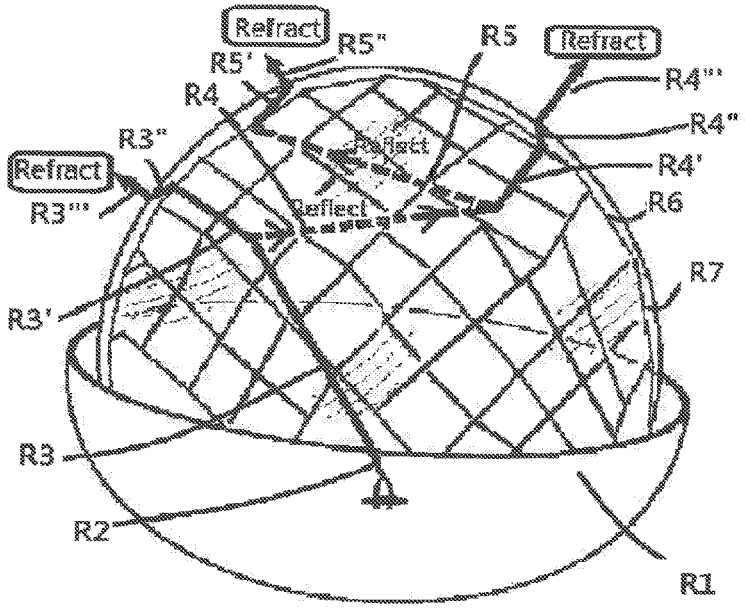
Figures 1, 4:
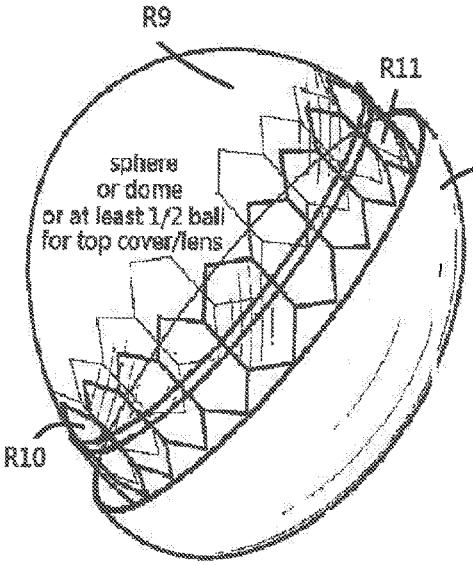
Figures 2, 4:
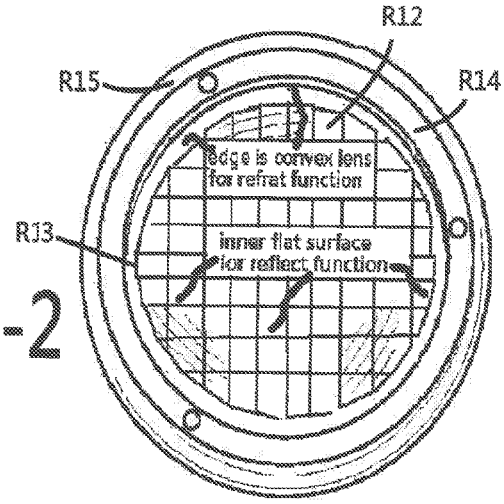

FIG. 1B shows a variation of the embodiment of which has three optics-elements having a plurality of tiny reflective-lens to form a big reflector, as shown in FIGS. 2 and 2A, the optics elements having different sizes, geometric shapes, thicknesses, foci, and colors, and may incorporate a motor, spin kit, rotating unit, movement, magnetic unit and coil assembly, shaking unit, waving kits, or crank-shaft to cause light beams from the fixed LEDs or laser-lights to travel and pass through the lower third optical-unit, which preferably is a crystal-ball or hexagonal prism like element that creates hundreds of light beams that hit the second optics-element, which may be a moving or steady reflector having a plurality of small reflective lenses arranged on a dish-like surface or an optics-element made of another material having shaped holes, windows, cutouts, or opening means to shape the light and form, for example, an aurora light shape, cloud shape, star shape, milky way shape, or galaxy shape, after which the light beams will hit the first optics-element which is a top cover optics-lens to spread the light beams out to a wider viewing angle.

FIGS. 1, 1A, and 1B therefore show arrangements in which light beam emitted out from the lower position's LEDs and/or laser-light(s) travel and/or pass through different second or third optics-elements to provide a plurality of light beams or shaped light beams that hit the cover optics-elements, which preferably is an optics-lens. The current invention can create perfect light effects which are very good design and cannot be made by a single optics-property, such as only by reflection or only by refraction.

As explained above, the embodiments of FIGS. 1, 1A, and 1B can include one or more of the following optics-elements:

(1) an optics-lens with textures;

(2) an optics-element made of another material having shaped holes, openings, cutouts, windows, stencils, film, slides, an LCD display, or wirelessly changeable images;

(3) an optics-element or optics-lens that moves and that may be incorporated with a crank-shaft, motor and axle, spin kit, rotating kit, clock movement, or magnet unit and coil assembly;

(4) an optics-element in the form of a geometrically shaped unit having a plurality of tiny reflective lenses arranged within a geometrically shaped surface and having different shapes, sizes, colors, thicknesses, and thickness variations to spread out the light beams from fixed LEDs and/or laser-light sources;

(5) an optics-lens in the form of a dome, half ball, ⅔ ball or sphere shaped cover which has a wide opening and that causes light beams to spread out to wider and bigger areas;

(6) an optics-element made of a preferred material such as plastic can be any shape such as sheet, piece, ball, half ball, dome, geodesic arrangement of hexagonal shapes, ⅔ ball, sphere, bar, cover or any other geometric shape having a preferred optical construction including textures, openings, windows, a convex lens, slide, film, character image, LCD display, magnifying lens, variable thickness, variable focus, plurality of tiny optic-lens, reflective pieces, or refraction-lens, and that is fixed or incorporated with a moving, waving, shaking, vibrating, or rotating device.

In the design of FIGS. 1, 1A, and FIG. 1B, desired light effects may be achieved with more than one LED and/or laser-light having different turn on and turn off times with a desired cycle, duration and frequency to provide the lighting with changeable colors and brightnesses that appear as moving or variable light effects to save a lot of complicated assembly or costs by eliminating the motor or movement.

The LEDs and/or laser-lights may have any desired color, specifications, size, functions, power, or wattage, and each LED and/or laser-light can have its own emitting direction, orientation, or angle with respect to one or more inner optical element so that even through the LED and/or laser-light emitting angles are narrow, the light beams will come out from the wide opening cover, which may include a flat, dome, ½ ball, ⅔ ball, sphere or dome shape, with a wider viewing angle image or lighted patterns on desired sides, areas, or surfaces.

Each of these embodiment may use features disclosed in the inventor's prior patents and patent applications, including (1) more than one LED or laser-light, (2) more than one reflective or refractive optics-lens or unit, (3) more than one optics-elements with desired optics properties, (4) selective incorporation of other parts and accessories in any desired combination, such as a motor, movement, magnetic unit and coil assembly for inductive control of optic-lens movement, interchangeable power sources, moving optics-elements, optics-elements made of light-blocking material having shaped holes, openings or windows, a textured lens, an optics lens, a plurality of optics lenses, an IC, a power source, etc. w The inventor's prior patents and patent applications include U.S. patent application Ser. Nos. 12/318,471, 12/318,470, 12/834,435, 12/292,153 (now U.S. Pat. No. 7,871,192), Ser. No. 12/232,505 (now U.S. Pat. No. 7,832,917), Ser. No. 12/318,473 (now U.S. Pat. No. 7,832,918), Ser. No. 12/624,621 (now U.S. Pat. No. 8,303,150), LED project light for Seasonal items, show all application has project assembly with all kind of type of power-kits including AC prong, AC plug-wire for outdoor lighting, garden light, seasonal light, seasonal light string. The current invention has big improvement has the more than one optics-lens and light beam passing through the $1^{st}$ and $2^{nd}$ optics means to created splendid color image or patterns. Ser. No. 12/771,003 (now U.S. Pat. No. 8,408,736), Ser. No. 12/876,507 (now U.S. Pat. No. 8,083,377), Ser. Nos. 12/886,832, 12/938,564, 12/948,953, and Ser. No. 13/021,107.

As shown in FIGS. 1, 1A, 1B, the light device is a plug-In type light device with a base installed on a plug-in housing to supply alternating current to drive the inner circuit, LEDs and/or laser light, a sensor, a switch, a controller or wireless controller, and an/or optional motor to move the optics-element, including but not to limited an optics-lens, in order to provide motion effects in an image projected to a ceiling, walls, or floor.

The geometrically-shaped optics-element(s) (7) or (3) may have a variety of desired optics properties including magnifying (3*a*)(3*c*)(3*d*) and diffusion (3*e*) or spreading (3*a*)(3*c*)(3*d*)(3*e*) (3*f*) (3*f*) (3*f'*) out of light beams (light beam path shown on dot, solid or bold line) that are achieved by (1) a mirror-polished reflective (3*b*) or refractive lens (3*a*)(3*c*)(3*d*)(3*e*), (2) a round convex surface (3*a*)(3*c*)(3*d*) outside of each inner reflective (3*b*) optics-lens so that it become a convex-lens and not only reflect the light beams but also allow light beam refraction as the light beams pass through a 180 degree or wide opening or flat, dome, or half ball, ⅔ ball, or sphere-shaped cover.

It is to be appreciated that details all of the Alternative Current (AC) AC type power unit, which are not shown, may include a receptacle and transformer, adaptor or AC wires or AC plug-wire. The adaptor or AC wires or AC plug-wire can be used to drive a circuit that causes the light source(s) to turn on and emit light beam to desire areas. It also can use USB port or wires to get power from USB ports. All these different type power unit for connect the light for indoor or outdoor application as above listed U.S. Ser. No. 12/624,621 (now U.S. Pat. No. 8,303,150), LED project light for Seasonal items, show all application has project assembly with all kind of type of power-kits including AC prong, AC plug-wire for outdoor lighting, garden light, seasonal light, seasonal light string. The current invention has big improvement has the more than one optics-lens and light beam passing through the $1^{st}$ and $2^{nd}$ optics means to created splendid color image or patterns. Also, The U.S. Ser. No. 12/624,621 is parent filed case of current invention as below reference.

(# II-2) U.S. application Ser. No. 13/540,689 filed on Jul. 3, 2012. Publication data US 2012-026-8668 dated on Oct. 25, 2012, Now is U.S. Pat. No. 8,511,877 issued date Aug. 20, 2013 v.s. Current parent (# QQQ-2012) U.S. application Ser. No. 13/540,728 filed on Jul. 3, 2012 now is U.S. Pat. No. 8,834,00 and (# ZZZ-2013) U.S. application Ser. No. 14/023,889 filed on Sep. 11, 2013 Now still has child case is pending. Which (# II-2) cover for all seasonal garden light and outdoor or-and garden project lighting.

This is continue in part of (# II-1) U.S. application Ser. No. 13/534,611 filed on Jun. 27, 2012, publication data US 2012/026-8947 dated on Oct. 25, 2012, now is U.S. Pat. No. 8,714,799 issued date Apr. 6, 2014 v.s. Current parent (# QQQ-2012) U.S. application Ser. No. 13/540,728 filed on Jul. 3, 2012 now is U.S. Pat. No. 8,834,00 and (# ZZZ-2013) U.S. application Ser. No. (# ZZZ-2013) U.S. application Ser. No. 14/023,889 filed on Sep. 11, 2013 now still child case is pending. Which (# II-1) cover for all seasonal garden light and outdoor or-and garden project lighting.

This is continue in part of (# II-2009) U.S. application Ser. No. 12/624,621 filed on Nov. 24, 2009, publication data US2010/0214541 date Aug. 26, 2010, now is U.S. Pat. No. 8,303,150 Issued on Nov. 6, 2012 v.s. Current parent (# QQQ-2012) U.S. application Ser. No. 13/540,728 filed on Jul. 3, 2012 now is U.S. Pat. No. 8,834,00 and (# ZZZ-2013) U.S. application Ser. No. (# ZZZ-2013) U.S. application Ser. No. 14/023,889 filed on Sep. 11, 2013 now still child case is pending Which (# II-2009) cover for all seasonal garden light and outdoor or-and garden project lighting.

The current invention is CIP of (ZZZ-2013) U.S. application Ser. No. 14/023,889 filed on Sep. 11, 2013 which filed 8 months earlier than issue date of (#II-1) U.S. application Ser. No. 13/534,611 filed on Jun. 27, 2012, publication data US 2012/026-8947 dated on Oct. 25, 2012, now is U.S. Pat. No. 8,714,799 issued date May 6, 2014 and Current invention filed on (#ZZZ-4) U.S. application Ser. No. 14/296,599 Filed on Oct. 18, 2016 which is Continue In Part filing of (# ZZZ-3) U.S. application Ser. No. 14/503,647 filed on Oct. 1, 2014 now is U.S. Pat. No. 9,719,654 which is Division filing of (# ZZZ-2) U.S. application Ser. No. 14/451,822 filed on Aug. 5, 2014, which is Continue In Part filing of (# ZZZ-1) U.S. application Ser. No. 14/323,318 filed on Jul. 3, 2014 which is Continue In Part filing of (# ZZZ-13) U.S. application Ser. No. 14/023,889 filed on Sep. 11, 2013.

Also, The (# II-2009) (# II-1) U.S. application Ser. No. 13/534,611 filed on Jun. 27, 2012 which is CIP of the (# TT-2010) U.S. application Ser. No. 12/866,832, Filed on Sep. 21, 2010 This is Division filing for (#TT-2) U.S. application Ser. No. 14/968,250, Filed on Dec. 14, 2015 which is Continue in Part of (# TT-1) U.S. application Ser. No. 14/944,953 Filed on Nov. 18, 2015 which is Continue in Part of (#TT-2010) U.S. application Ser. No. 12/866,832, Filed on Sep. 21, 2010

This is Division filing for

Related to the wider area image or project image night light or LED bulb or AC plug wire LED outdoor light with or without motor/spin/rotating kits for moving image. This is Division filing for Related to the wider area image or project image night light or LED bulb or AC plug wire LED outdoor light with or without motor/spin/rotating kits for moving image.

FIGS. 1-6, 1-7, 1-8, 1-9, and 1-10 show an LED (U1) and/or laser (U4) light device having a bulb-like housing (U8) (U7) and bulb-base (U8-1) with current delivery terminals (U8-1) (U7-1) (3) rather than prongs (U6-1) to obtain AC power. The bulb-like device is one of garden light or LED bulb having a bulb-base (U8-1) can be used at higher locations than a prong device plugged into a typical outlet or wall or extension cord for indoor or outdoor use.

FIGS. 1-1, 1-2, 1-3, and 1-4 show further details of the first preferred embodiment of the current invention, including the two optics elements (T1) (T2), one of which is a top cover (T2) optic-lens with refractive and/or reflective properties and one of which is an inner disc-like optics-lens (T1) having refractive and/or reflective properties or a convex lens with wave-textures and varying thickness and arranged so that light beams from the LEDs (T0) and/or laser—lights (not shown) will first pass through the disc-like optics-lens (T1) or optics lens with wave textures and then travel or pass through the top cover (T2) to create a super large size viewing angle image, lighted patterns, message, time, geometric art, nature scene, galaxy, milky way, sky, cloud, starts, moon, water waves, animal, characters, cartoon, sign, logo, or commercial.

As shown in FIG. 1-1, the light device of the first embodiment can get AC power from AC prongs or AC plug-wire, or AC bulb base, or DC power from a USB female port or battery. The prongs, AC plug-wire, bulb base and USB female ports or battery all need positive and negative current connections to two prongs, two terminals of AC plug or the bulb base, or two ends of the USB female ports or battery compartment, so the current invention can have different shapes with the same optics applications, differing only in the power source connections as above discussed 4 example but not limited for other connectors for same function to delivery AC power source to light device. From FIG. 1-2 show prong (T3') and From FIG. 1-3 show AC plug-wire (T3") and From FIG. 1-4 show outside transformer (T3") are show example to connect with AC power source.

FIGS. 1-1, 2-1 and 2-4 show prong-less arrangement that can draw DC from USB female ports or any direct current device such as batteries, energy storage means, solar power, wind power, and chemical power devices.

The light device of the present invention can also utilize interchangeable power sources as in the inventor's above-cited U.S. Pat. No. 8,434,927.

From FIG. 1-5 original filed text-box from top to bottom has:

1. Sphere shape outside optics element has desired texture on surface(s), 2. Inner optics lens has optics texture and properties to make light beams from LEDs or laser to create wide viewing angle image for any predetermined design, 3. Middle base which to fit the outside sphere optics cover to the lower base, 4. PCB cover and inner lens installation bracket to prevent from people touch the electric parts and accessories while cover break, 5. LED cover with desired textures, 6. LED or laser light source with ties PCB, 7. CDS or other sensor, switch, motion sensor, remote controller, blue tooth, infra-red or other market available controller, 8. Electric part & accessories to get input and output current & functions for LEDs or laser light source, 9. Prong or USB means, 10. Circuit get power from AC to LED or laser trigger current and voltage. 11. Main base to hold circuit board, prong, LEDs or laser. All electric parts and accessories.

From FIG. 1-5 show the alternative embodiment to show the outside optics-lens or outer cover in sphere or desired geometric shape (16*f*) and inner optics-lens (16*e*) both has desired optics-properties may selected from (1) reflective or-and (2) refractive or-and (3) diffusion or-and (4) grating to split-laser light-beam. The LED or-and laser light (16*h*) has the base (16*a*) to hold all parts including the AC power-kit here is prong (16*b*) and the inner sensor or switch or other electric-parts (16*g*) and circuit board with LED(s) or laser light source (16*n*) which has preferred or desired add-on $3^{rd}$ optics-lens to make light-beams for more wider or narrow emit-out angle. The said inner also has one inner-divider (16*c*) which to assembled with base (16*a*) to sealed all electric parts & accessories so people can not touch all these electric parts or accessories has current connection for safety reason. The light (16*h*) has the collar (16*d*) to make assemble the inner and outside optics-lens to base. By way of examples and without limitation, such as all the LED light for different application including indoor or outdoor light, indoor plug-in light or outdoor AC plug-wire powered garden light, seasonal light, project light, patio light all the housing and inner or-and outer optics-lens for shape and size and thickness and assembly skill should still fall within the current invention scope as long as the light has LED or-and laser light-beams is travel from light source to $1^{st}$ optic-lens and go through the $2^{nd}$ optics lens both at least has both reflective or refractive optics properties to form the lighted patterns or image to show on the feet away surface(s).

From FIG. 1-6 original text-box text has:

1. The more than one optics-elements LED or Laser device can be powered 1. Bulb-Base with prong 2. Prong or other to plug-in outlets 3. USB kits, 2 Top cover is $1^{st}$ optics-element, $2^{nd}$ optic-element is inner optics-lens, 3. Show all the light-beam reflection or-and refraction from LED or-and Laser light source, 4. USB kits or port 5. AC type power kits including prong, 6. Bulb-base to screw into bulb receptacle.

FIG. 1-6 shows details of the second preferred embodiment of the current invention, which may use a bulb base (U8-1) as a power supply, or other power supply connections such as prongs (U6-1) or AC plug-wire (U7-1) or USB kits (3). FIG. 1-6 also shows the inner design which consists of LED lights (U1) and/or laser lights (U4) (light-beam travel path shown as full lines and dotted and bold lines) that emits light beams (LED path 1,2,3,4,5) (Laser Path), to the first optics-element (U2), which may be a convex lens or reflective and refractive lens has optic-properties (Ra)(Rf) and the second optics-element, (U3) which may be a second optic-lens having reflective or-and refractive properties (Ra) (Rf) to enlarge and spread out the light beams (LED path 1,2,3,4,5) (Laser Path), emitted out from the first optics-element, which is preferably a convex reflective or-and refractive lens, to the outer lens (sphere) of the first optics element for reflection and refraction.

As mentioned above, the light device of FIG. 1-6 can have prongs (U6-1) (U7-1) such as those shown in FIGS. 1, 1-2, 1-3, and 1-4 so that it can be plugged into an outlet device on a wall, power strips, or s desk top power station or outdoor extension cord. When incorporated with a bulb-base (U8-1), it is simple to change the product housing shape (U6) to a bulb-like shape (U8) and the two power terminals of AC prong or AC plug-wire (U6-1) (U7-1) can easily be connected on a bulb base (U8-1) wall (not shown) for one pole and bulb base bottom (not shown) for a second pole, without changing the optics parts and accessories with respect to those of the prong (U6-1) (U7-1) products. Furthermore, when people would like to use USB female ports (3) to connect with power source by USB wires (not shown), it is simple just add one USB female port (3) to the housing shown in FIGS. 1, 1A, 1B and 1-1 to 1-4 so as to instantly change from supplying AC power by prongs (U6-1) (U7-1) to supplying DC power by the USB female ports (3) by modifying type of power unit without changing the arrangement of optics parts and accessories.

As shown in FIGS. 1-6, 1-7, 1-8, 1-9, and 1-10, the second preferred embodiment of the current invention has two optics elements (U2) (U3) or (18*c*)(18*d*): a top cover (U3) (18*d*) (18*g*) on the outside, and inner disc-like convex or reflective or-and refractive lens (U2) (18*c*). The two optics elements both have preferred textures and designs (wave-like or others) or different the thickness of the lens so that the said LED lights or laser-lights can pass through the inner disc-like convex or reflective or-and refractive lens which has a designed thickness or texture (wave-like), or lights can pass through alternative optical elements such as holes, stencils, walls, openings, or cutouts and then pass through the outer optics element having at least one refractive or reflective or-and refractive properties that enlarge and spread out the light beams that form projected images, such as lighted patterns or a message(s), number(s), time, geometric art(s), nature scene(s), galaxy(ies), milky way, sky(ies), cloud(s), space nebula, stars, moon, water-wave(s), aurora light(s), animal(s), character(s), cartoon(s), sign(s), logo(s), or commercial(s) for all kind of indoor or outdoor LED light applications including LED garden light, LED seasonal light, LED AC Plug wire light, LED AC plug-in light has project lighted image or lighted patterns functions. FIGS. 1-6, 1-7, 1-8, 1-9, and 1-10 also show different type of power unit to connect with AC power source housings such as a cone-like bulb housing (U8) having a bulb base (U8-1), which may be selected from any bulb base shape available from the marketplace including bulb bases such as e12, e17, e26, etc.

FIGS. 1-7, 1-8, 1-9, and 1-10 show a fourth preferred embodiment that has a bulb shape (U8) light unit with a bulb-base (U8-1) that can acquire power from any bulb bases that are connected to an AC power source, such as lamps, or bulb base adapters. The bulb base is not limited to one specification; any bulb bases (most commonly E12, E17, E26) can connect to the current invention. In addition or alternatively, the current for different product housing (U6) (U7) (U8) designs can be supplied through any appropriate power unit with preferred terminals including prongs (U6-1) (U7-1), a bulb base (U8-1), and USB female ports (3) that can be prong to plugged in, or AC plug-wire to plug-in hard-wired, or screwed in tightly to ensure the current is connected between the AC power source to the said the light sources or circuit or other devices of the invention.

From FIG. 2 original filed text-box has: two inner optics-element has plurality preferred optics design The inner light effects piece has many different size, shape, thickness, optics properties, focus, reflection, refraction optic-areas or section to make light-beam to traveling or passing through for inner optics-element so can make multiple colorful LEDs or laser light source(s) light beam to spread out and has desired image and incorporated with motor/movement/spring/moving/motion/magnetic & coil items to create the moving effects of cloud, starts, galaxy, silver river, water wave, aurora, or other nature scene all kind of surface may including ceiling, walls, floor, building to be view by viewer.

From FIG. 2A original filed text-box has: The optics arrangement for LED(s0 or Laser(s) to create fake nature scene including the inner optics-element has reflective or-and refractive which has plurality of reflective tiny surface(s) and optics ball so allow the LED(s) or laser light beam can traveling or passing through the 1$^{st}$ inner optics ball and some light beam reflected to surrounding reflector's plurality surfaces some light beams refracted by optics balls to viewer or impact to the reflector's plurality of surface(s) so created the some laser image and some LED image may incorporate with motor/spin/movement/motion unit/magnetic & coil units to make the image not steady but also moving. Or use LED(s) or Laser(s) different turn on-off timing with preferred distance, position, orientation to look the image moving but without use the motor/spin/movement/motion unit/magnetic & coil items for lower-end cost products.

FIGS. 2 and 2A show a third preferred embodiment of the current invention's optic elements, which include an inner optics-element in the form of (1) FIG. 2 show a reflective or-and refractive or diffusing or split-out unit having a plurality of small size, different optics properties lenses built into a one piece, or (2) FIG. 2A show the one of metalized treated reflector, although it will be appreciated that the optics elements may include other optics units having different sizes, shapes, thicknesses, foci, reflective properties, and/or refractive properties to cause light beams from the LED(s) (V4) (V8) and/or laser-light(s) (V1) (V8) to travel or pass through the inner or 1$^{st}$ optics-elements or optics-lens and create splendid and pre-designed light beam patterns, colors, shapes, brightnesses, and other light effects, performance, and functions, and which further may incorporate a motor/movement/spinning/rotating/magnetic unit and coil assembly-to provide motion effects. The more than one optics-elements above the light source (LEDs and/or laser-lights) may include facets of a center crystal-like optics ball (V8), with some of the light beams traveling and passing though the crystal-like optics ball and emit to or emit on reflective or refraction theory reflector (V9) to create very eye-catching light effects. Both optics-elements of FIGS. 2, 2A or other current invention LED or-and laser project light the said optics-element or image-forming unit or display-unit any one or desired combination can cooperate with a motor/moving/spinning/rotating/magnetic unit and coil assembly to move one or both of the optics-elements to get the desired light effects.

As shown in FIGS. 2 and 2A, the two preferred optics-elements may (1) As FIG. 2 have a built-in plurality of tiny reflective or-and refractive or diffusing or split-out optics-lens or optics-segments (V2) (V5) of different size, shape, thickness, focus, and/or color, and (2) As FIG. 2 an optics lens in one disc-shape reflector piece to create the splendid light performance, effects, functions.

From FIG. 2A, it will also be appreciated that the more than one optics element(s (V8-1)) and LEDs and/or laser-lights (not shown) will also incorporated with other electric parts and accessories in any combination selected from a power source, circuit, motor (base of inner construction), movement, spin kit, rotating kit, magnetic unit and coin assembly, IC, sensor, controller or wireless controller, conductive piece, prong, bulb base, USB set, circuit, and all other electric parts and accessories required to provide a desired predetermined light function.

From FIG. 2-1 original text-box text from top to bottom: The wide angle outer optics element has its preferred texture to get desired light performance, effects, 2. The $2^{nd}$ optics element is the $2^{nd}$ inner optics elements made of light block-material has holes, openings, windows, cutouts, stencils to allow LEDs or laser(s) light beam to passing through inner the optic elements has LED or laser cover to make the LED or laser emit light beam to desired effects, 3. Hold-unit also is axis-unit to connect the motor/spin/rotating device to make $2^{nd}$ optics element to move, rotating, 4. Base has one and two piece to install all parts and accessories into the base parts, 5. The inner optics element said window which is allow light passing through but not opened. The opening or cutouts, stencil, holes which is not like window.

From FIG. 2-2 original text-box has: 1. top is wide angle cover has optics textures to make desired light effects to create wide viewing image, aurora, cloud, stars, galaxy, water wave, or nature scene . . . to be seen by viewers, 2. The $2^{nd}$ optics-element made by light-block material has openings, windows, cutouts, holes, stencils to allow the light passing through to create desired image, 3. Windows of inner optics-element light can passing through may has some material or film existing so finger cannot passing through, 4. Light device has hold kits or axis kits to connect with motor, spin, rotate unit.

From FIG. 2-3 original text-box has: 1. Top cover optics-element to refract light beam to wider viewing angles to be seen.

From FIG. 2-4 original text-box has: 1. Top cover optics-elements allow light refracted to outside, 2. Inner optics-elements has opening, cutout, holes, stencils has nothing on the areas not same as window has film or material within the window, 3. Has hold or axis unit to connect with moving/motor/rotate unit.

From FIG. 2-5 original text-box has: 1. Hold or axis unit to hold the light block piece and connect with lower motor/spin/moving/curating/movement/magnetic & coil unit which let the light block piece to rotating or moving to make aurora, clouds, star, wastewater, galaxy . . . has moving effects. As shown in FIGS. 2-1, 2-2, 2-3, 2-4, and 2-5, the second preferred embodiment is the same as the embodiment of FIG. 1C for moving optics-elements (80) or moving light sources (not shown) in which the inner optics-elements (80) are not lenses but rather have area(s) with shaped openings (81), cutouts (81*a*), holes (81*b*), stencils (81*c*), film (80) or printed piece (80), or windows (80) to allow light beams to pass through the areas (81*a*)(81*b*)(81*c*)(81*d*) but not from the light-blocking-area(s)(82) to form shaped lighted patterns.

The shaped light pattern en traveling (or being reflected or-and refracted by) or passing through and refracted by the top wide viewing angle or flat cover (83) which may a flat cover (83) or the cover has preferred (1) optics textures (or a plurality of convex or concave small lens pieces combined into one big diffusing or-and refractive or-and refractive cover as FIG. 2 shown), or (2) the cover (80) has its preferred treatment with different thicknesses, or (3) the cover (80) has its preferred treatment convex or concave lens properties, or (4) the cover (80) has its preferred treatment reflective and/or refractive properties to form a desired image, lighted patterns, message, time, geometric art, nature scene, galaxy, milky way, sky, cloud, starts, moon, water waves, animal, characters, cartoon, sign, logo, or commercial. The second embodiment also may incorporate a motor/movement/spinning/rotating/moving/magnetic unit and coil assembly to move the optics-element(s) (80) and/or light source(s) and create motion light effects for desired all kind of LED light device including garden light, outdoor light, plug-in light by prong or AC-Plug-wire. This will increase the value of the current invention.

From original filed drawing box-text show FIG. 2-2 has (1) inner $1^{st}$ optic-lens has shaped openings (91), cutouts (92), holes (91) has real area has no light-block-material so light can passing through, or-and (2) hold-unit (94) or axis-unit (94) to connect with motor (not shown), spin, rotate device, or-and (3) the inner optics-lens made by light-block material has opening (91), window (92), cutouts (91), holes (92), stencils (90) to allow the light passing through to create desired image, or-and (4) top wide angle cover (93) has optics textures to make desired light effects to create wide viewing image, aurora, cloud, stars, Galaxy, water wave, or nature scene . . . to be seen by views.

From FIG. 2-3 original filed drawing box-text show the all kind of LED project light for indoor or outdoor light application(s) has (1) top cover optics-unit to refract light beam to sider viewing angles to be seen, or-and (2) has conductive-piece unit including prongs to connect with power source.

From FIG. 2-4 original filed drawing box-text show the all kind of LED project light including garden, outdoor, patio light for daily or seasonal applications has (1) shaped openings (110), cutouts (111), holes (113), stencils has nothing inside on the areas, or-and (2) hold unit (111) or axis (111) to connect with moving, motor, rotate device, or-and (3) Top cover optics-lens (112) allow light refract to outside, or-and (4) Windows has light pass material existing that areas.

From FIG. 2-5 original filed drawing box-text show the all kind of LED project light has (1) hold or axis unit (122) to hold the light-block unit with opening (120)(121) and connected with lower motor, spin, moving, rotating, movement, magnetic & coil unit which let the light-block unit to rotating or moving to make aurora, cloud, star, water wave, galaxy . . . has moving effects, or-and (2) shape opening, cutouts (120), stencils (121), holes (120) to allow light passing through to top cover optics-lens, or-and shape or design window.

From FIG. 2-6 original Filed Text-Box from top to bottom has:

1. #1 top optics cover has its texture to allow refraction light beam to wide viewing angle to be seen,
2. #1 base to assemble the top optics-cover with lower base
3. Has hold or axis unit which hold moving light-block optics-piece and connect with lower level's motor/movement/spin/rotate/magnetic & coil unit to make the said moving optic-piece and allow light passing through its holds, window, cutouts, stencils, opening.
4. $3^{rd}$ optics element has a lot of different shape, size, area, thickness optics-areas to make light beam traveling or passing through to make light beam reflected or-and refracted to plurality direction for design shaped light image to create desired light performance.
5. LED or laser light source to emit light beam travel or pass the said more than one of optics-element which has passing through or refractive or-and refractive with its design to create image to be seen.
6. #2 base to arrange related circuit, controller, sensor, switch, PCB and all related electric parts and accessories to make the said LEDs or laser light beam pass through more than one optics-elements for wider image to be seen.
7. $2^{nd}$ optics element which made of light-block material has plurality of shaped holes, opening, cutouts, windows to allow light to passing through these opening or windows so can created shaped light areas to be seen.

8. Tray to arrange LEDs or laser light source on position, also arrange the top #2 light block optics piece and hold-unit to connect with lower level motor/movement/spin/rotating/moving/magnetic & coil units to make the #2 optics-elements to moving or rotating.
9. Motor/moving/spin/rotating/movement/magnetic & coil unit which allow the top optics-element(s) or LED(s) or laser (s) to change position, location, orientation to make the moving effects may selected from group combination of cloud(s), start(s), milky river, solar system, or any nature scene with wide size to be seen.

FIG. 2-6 shows inner construction details of the second embodiment, in which the light device has a built-in motor (w1) (or equivalent device) fixed on the housing (w) by, for example, a screw. The motor has an optional gear-set (not shown) to reduce the motor's rotating speed to a slower speed that prevent viewer discomfort resulting from overly rapid movement of images on the ceiling, walls, or floor, building, housing, garage door. Not shown are optionally included parts such as a switch or other electric parts and accessories such as conductive wires to connect with circuitry and a power source.

From original Filed drawing FIG. 2-6 box-text show the all kind of applications LED or-and Laser outdoor project light has (1) motor (w1), moving (w1). Spin, rotating, movement (w1), magnetic & coil unit (not shown) which allow the top optic-element (w3) (w4)(w8) (w4-1) or LED(s) (w3) or laser (s) (w3) to change position, location, orientation to make the moving effects may selected from group combination of cloud(s), star(s), aurora, galaxy, milky river, solar system or any nature scene with wide size to be seen, or-and (2) has base (w) to arrange related circuit, control-circuitry, sensor, switch, PCB and all related electric parts and accessories to make the said LEDs (w3) or Laser (w3) light-beam through more than one optics-lens (w3) (w4)(w8) (w4-1) (w7) for wide image to be seen, or-and (3) LED(s) (w3) or Laser light source (w3) to emit light beam travel or pass the said more than one of optics-lens (w3) (w4)(w8) (w4-1)(w7) which has passing through or reflective or-and refractive with its design to create image to be seen, or-and (4) optional tray to arrange LED or laser light source on position. Also, arrange the top light-block optics-units and holder to connect with lower level motor movement, spin, rotating, moving magnetic & coil set to make the desired number of optics-element to moving or rotating, or-and (5) replace or optional or added $3^{rd}$ optics-element has a lot of different shape, size, area, thickness optic-lens in a place to make light beam traveling or passing through to make light beam reflected or refracted to plurality direction for design shaped light image to create desired light performance, or-and (6) the preferred $2^{nd}$ optic-element which made of light-block material has plurality of shaped holes, opening, cutouts, windows to allow light to passing through these opening or windows so can create shaped light areas to be seen, or-and (7) hold-unit or axis-unit which hold moving light-block optics-element and connect with lower level's motor, movement, spring, rotate, magnetic & coil set to make the said moving optics-element and allow light pass through its holes, windows, cutouts, stencils, openings, or-and (8) Top has No. 1 base to assemble the top optics-cover with lower base, or-and (9) Top is Number 1 top optics cover has its texture to allow refraction light beam to wider angle viewing angle to be see.

From FIG. 3-1 original fled text-box has following text:

$1^{st}$ preferred embodiment of moving optics-element

1. Top optics-element has its water wave texture with vary thickness so can has refractive and reflective to let light beam traveling or passing to surface
2. #1 housing to arrange hold and fix parts and kids and optics-elements with lower base
3. $2^{nd}$ housing parts to arrange all circuit parts and accessories and optics elements so can have safety unit FIG. 3-1 shows the third preferred embodiment, which again has more than one optics element (31*d*) (31*e*) including a top approximately 180 degree wide opening optic-lens cover (31*d*) which preferably has wave-like textures (not shown) or a plurality of small convex lenses (31*e*) with different foci or sizes mixed with a variety of thicknesses and/or refractive and/or reflective properties so that when the light beams from the LEDs and/or laser-lights hit the cover, some light beams will reflect and some light beam will refract to a viewer or desired areas.

From FIG. 3-2 original filed text-box has: $2^{nd}$ preferred embodiment has moving optics-element application 1. $1^{st}$ optics-element as top cover with preferable texture and allow LEDs or Laser light beam can pass, traveling the said wide angle top cover to create wide size image to viewers.
2. #1 housing to hold the $1^{st}$ top optics-cover
3. Has magnetic unit and magnetic coil unit
4. $2^{nd}$ optics element has preferred wave vary thickness and connect with motor. Moving unit, crane-shift, arms, movement, magnetic & coil unit to make the $2^{nd}$ or inner optics-element become moving optics elements.
5. Tray or holder to hold light source(s0 may for LED or laser(s) and bracket to hold the moving optics element and motor, movement, magnetic & coil units.
6. LED or laser light with its circuit and electric parts and accessories.

As shown in FIG. 3-2, the inner second optics elements may be moving optic-elements (202") connect with a motor (not shown) or magnetic unit (202A) (202B) and coil assembly (202E) that causes shaking, waving, or other motion of the moving optics-elements (202") so that light beams traveling or passing though the inner moving optics elements (202") will change position, direction, or orientation and hit the top cover's optics element(s) (203") to provide splendid light effects that may include any combination of image, lighted pattern, message, time, geometric art, nature scene, galaxy, milky way, sky, cloud, starts, moon, water waves, animal, characters, cartoon, sign, logo, or commercial.

FIGS. 4-1, 4-2, and 4-3 show an alternative design for top cover optic-elements (R1) having a plurality of reflective and/or refractive optics-areas arrangements to form one dome (R7) or a spherical lens (R7) design to cause light source light beams (R2) to be (A) reflected back and forth within the top cover (R7) and lower parts, or (B) transmitted-out from $1^{st}$ hit to the optic-area(s) and spread out to obtain a wide range, big size image. The current invention can use a half ball (R7), ⅔ ball (R7), or sphere shaped top cover (R7) to obtain the desired wider area lighted patterns because the top cover optics-elements (R7) consist of more than one reflective (Inner flat and polished) and/or refractive lens (outer curved) formed by an injection process into a one piece ball (R7), ball-like (R7), sphere (R7), half ball (R7), or ⅔ ball (R7) shaped object top cover (R7), which is incorporated with the at least one inside LEDs (As FIG. 4 shown) and/or laser light source (not shown) having a predetermined color, number, brightness, IC, sequential, cycle, duration time, fade-in-N-fade out, or pair flashing to get desired light effects. This embodiment may also be provided with a moving device selected from a motor, spin kit, rotating kit, clock movement, timer, sensor, and switch, and connected to a power source by prongs, a AC plug-wire, a bulb base, or USB kit for plug-in AC prong or AC plug to outlet of wall or extension cord or power strips or insertion into a bulb socket or USB port.

It will be appreciated that alternative designs for the top cover with (1) convex or (2) reflective or-and refractive properties optics lens features may also still fall within the current invention scope, as disclosed in the above-cited parent applications for all kind of LED light device has projection functions including outdoor light, garden light, seasonal light as co-pending parent filed cases as above listed 9 patents application with current improvement constructions.

FIG. 4 shows an embodiment in which light beams emit from lower cover or housing (R2) (R3) reflect or-and refract within more than one reflection or-and refraction area(s) or the top-cover and lower cover areas or-and surface to get light-beam (R4)(R5) (R4') on an inside of an optics-lens (R7) is in the shape of a sphere. The light beams (R3") (R5') (R4") then pass through the outside convex-lens (R7) to project the image or lighted patterns (R3'") (R5'") (R4'") to ceilings, walls, or floor or building or housing, or garage door. This embodiment includes the following features: (1) more than one reflection-areas or surface inside of an optics-lens and a refraction-surface outside the same optics lens, (2) light projection through the more than one optics-surface of the one piece of optic-lens, the inner side of which is a flat mirror-polished reflector and the outside of which is a convex-shape lens so that two kinds of optics-properties are provided in one optics-lens, (3) each reflective and refractive lens gets together to form a semi-sphere geometrically shaped outer optics-lens. (4) a half-sphere ball, ⅔ ball, dome or sphere are preferred designs. From FIG. 4 show (AA) the light is reflected or-and refracted within the top cover, lower cost or lower housing back-and-forth and emit out from top-cover. From FIG. 4 show (BB) The said optics-lens (R7) is not the same wall thickness on each small-areas so while in-put light-beam emit to reflective or-and refracted with angle on whole dome or sphere top cover or flat optics-elements not like co-inventor's the light beam is parallel with the optic-elements and only on one-end of the optic-element is reflected to light source direction.

FIG. 4-1 shows a ⅔ ball shape optic-lens (R9) having-both reflective and refractive optics properties and a base (R8) to form the LED and/or laser light device which has more than one optics-property. The ⅔ ball outer cover (R9) has more than one reflector and/or refraction lens (R10). This is different than the inventor's earlier U.S. Pat. No. 7,632,004, which discloses an LED night light having more than one optics means, U.S. Pat. No. 8,277,087, which discloses an LED light having more than one reflection means And (AAA) the light beam is travel along the parallel optics-tube so whole elongate tube has no reflective only at the top-end to reflect the light-beam back to light source direction, and (BBB) the all optic-tube its thickness is even thickness so it only reflected on top-end which is not same as the current invention the whole $1^{st}$ or $2^{nd}$ or top cover has everywhere has the reflected or-and refracted areas or surface, U.S. Pat. No. 7,455,444, which discloses an LED night light having more than one LED, and U.S. Pat. No. 8,434,927, which discloses an interchangeable power source that may be utilized in the current invention. The prior light devices use two separate pieces rather than built-in one piece optics-lens, but principles disclosed in the prior patents can still be utilized by the current invention.

FIG. 4-2 an inner side of another viewing angle of FIGS. 4, 4-1 of optical-lens (R7) (R9) which has more than one flat reflective surface (R12) inside of the optics-lens (R7) (R9) overcome the LED's narrow light beam angle by causing light beams been reflected and to travel in different directions after going through multiple inner flat reflective surfaces (R12). Even the light angle is initially narrow, it is not a problem because the light emitted from the LED and/or laser light source will hit the first reflective surface (R12), then hit a second, third, fourth, or more reflective surfaces 1 until the light beam passes through the outside multiple convex-surface of the ball-like outer optics-lens (R7) (R9) A motor can be added make the image rotating move.

In the preferred embodiments, images are created based on the relationship between the first optics-element(s) and the second optics-element(s) or all other optics-element(s). The light device can employ any kind of design, shape, display, or geometric arrangement of the more than one optics-elements to create a big size or large image to cover a big area for special light effects though the big or wider opening of the top cover with desired reflective or refractive lens assembly.

Although specific preferred embodiments of the current invention are described above, it is to be appreciated that all alternative, equivalent, same-function and/or same-skill-or-theory variations, modifications, replacements, arrangements, or constructions may still fall within the current scope of the invention.

Basing on the Claim words hereafter listed the each key words supported by the text:

1. Inner and outer optics element: Show on FIG. 1-5 text box.

I claim:

1. An LED light device having more than one optics element to project an image or lighted pattern, comprising:

at least one LED light source; and more than one optics element having a geometric shape, each said optics element having reflective, refractive or both reflective and refractive properties, wherein the more than one optics element includes (a) at least one rotating or moving first optical element arranged to reflect, refract or reflect and refract light beams from the at least one LED light source, and (b) at least one second optical element arranged to further reflect, refract or reflect and refract the light beams reflected, refracted or reflected and refracted by the first optical element, wherein the at least one second optical element is a flat or curved top cover to project the image or lighted pattern onto at least one external surface outside the LED light device, wherein said at least one LED light source is connected to a power source by conductors and circuitry for causing said at least one LED light source to turn on and off for a predetermined period to provide predetermined functions, colors, and effects, wherein at least one of the more than one optics element includes properties or treatments selected from different or variable thicknesses, textures, waved surfaces, different or multiple reflective, refractive or reflective and refractive surfaces, printing, painting, or marking, and protective properties, and wherein said LED light device is a plug-in outlet device or an AC wire powered device with a built-in or external AC-to-DC circuit connected to the power source.

2. An LED light device as recited in claim 1, wherein at least one said more than one optics element is selected from the group consisting of a fine-polished piece, optics lens, light blocking material having a shaped opening, cutouts, holes, windows, stencil.

3. An LED light device as recited in claim 1, wherein at least one said more than one optics element is selected from at least one of the following types of optical elements:

(1) optical elements having textures;

(2) optical elements having shaped holes, openings, cutouts, windows, or a stencil;

(3) moving optical elements incorporated with an assembly that includes at least one of a crank, motor, gear set, spin mechanism, rotating mechanism, movement, and/or magnet and coil assembly;

(4) optical elements having a plurality of different shapes, sizes, colors, optical properties, or thicknesses in one piece to cause light beams from at least one fixed or moving LED or laser light source to spread out; and (5) optical elements included in a cover assembled to a base housing and having a wide opening to increase a viewing angle and cause all light beams to spread out.

4. An LED light device as recited in claim 1, wherein said power source is selected from the group consisting of an outlet, batteries, solar power, chemical power, and wind power to provide electricity through related circuit to drive said at least one LED light to emit light beams.

5. An LED light device as recited in claim 1, the moving device including at least one of a motor, spin mechanism, magnet and coil assembly, movement, and gear set that fit within the LED light device to cause at least one of the first and second optical elements to rotate and cause the projected image to move.

6. An LED light device as recited in claim 1, wherein said LED light device is selected from a single or multiple color light device, a multiple piece light device with pieces having different optics properties, a standard unit, and a custom made assembly.

7. An LED light device image as recited in claim 1, wherein said LED light device is pluggable into a plug-in outlet device including a wall outlet, receptacle, extension cord, power strip or cigarette lighter.

8. An LED light device as recited in claim 1, wherein at least one said more than one optics element is selected from at least one of a light-transmitting lens, reflective lens, refractive lens, convex lens, concave lens, laser grating lens, hologram lens with preferred texture, lens with a polish finished surface, lens with different thicknesses or foci, a plurality of tiny optics element combined into one piece.

9. An LED light device having more than one optics element to create a wider viewing angle image or lighted patterns, comprising:

a plurality of LEDs, at least one laser light source, or both said LEDs and laser light source; and more than one optics element having a geometric shape, said optics element each having (a) reflective or refractive optics-properties, (b) a grating for splitting a light beam into multiple light beams, (c) a hologram piece, or (d) a piece having pin or shaped holes;

wherein at least one said optics element reflects, refracts, or diffracts a part of light beams before they travel or pass through at least one other said optics element to create a wider range or bigger size of image or lighted patterns for projection onto at least one outdoor surface or structure while connected with circuitry and a power source by a conductive piece or a wire with a plug, wherein at least one of the more than one optics element rotates or moves and includes properties or treatments selected from different or variable thicknesses, textures, waved surfaces, different or multiple refractive, reflective, or grating surfaces, printing, painting, or marking treatments, concave or convex lens surfaces, and protective properties of a protective grating piece, wherein said plurality of LEDs, at least one laser light source, or both said LEDs and laser light source are connected to a power source by conductors and circuitry including a controller for causing said plurality of LEDs or laser light sources to turn on and off for a predetermined period to provide predetermined functions, colors, and effects, wherein said image or lighted patterns includes at least one of a lighted message, time, geometric art or shape or contour, nature scene, galaxy, milky way, sky, cloud, stars, moon, water waves, aurora light, animal, -character, cartoon, sign, logo, and commercial, and wherein image or lighted pattern moving effects are created by at least one of:

(a) circuitry that causes said plurality of LEDs, or at least one laser light source, or both said LEDs and laser light source to sequentially flash, fade-in and fade-out, change colors, randomly turn on and off, or exhibit other light performances, effects, duration, or duty cycles to cause a viewed image to appear to be moving, (b) a motor, gear set, spin device, movement, or magnetic device to rotate or move the at least one of the more than one optics element; and (c) both said circuitry and said motor, gear set, spin device, movement, or magnetic device.

10. An LED light device having more than one optics element to create a larger size image or lighted patterns, comprising:

a plurality of LEDs, at least one laser light source, or both said LEDs and laser light source; and more than one optics element having a geometric shape, said optics element each having (a) reflective or refractive optics-properties, (b) a grating for splitting a light beam into multiple light beams, (c) a hologram piece, (d) a piece having pin or shaped holes, or (e) textures, printing, painting, or marking treatments;

wherein at least one said optics element reflects, refracts, or diffracts a part of light beams before they travel or pass through at least one other said optics element to create a wider range or bigger size of image or lighted patterns for projection onto at least one outdoor surface or structure while connected with circuitry and a power source by a conductive piece or a wire with a plug, wherein the plurality of LEDs or at least one laser light source selected from any combination of a single color, multiple color, multiple piece, standard, and special LEDs laser light sources having a predetermined wattage, size, spacing, distance, or orientation, wherein at least one of the more than one optics element rotates or moves and includes properties or treatments selected from different or variable thicknesses, textures, waved surfaces, different or multiple refractive, reflective, or grating surfaces, printing, painting, or marking treatments, concave or convex lens surfaces, and protective properties of a protective grating piece, wherein said image or lighted patterns includes at least one of a lighted message, time, geometric art or shape or contour, nature scene, galaxy, milky way, sky, cloud, stars, moon, water waves, aurora light, animal, character, cartoon, sign, logo, and commercial, wherein image moving effects are created by a motor, gear set assembly or movable device to move at least one of (a) a moving optical element made of a light block-out material with shaped-openings, cutouts, windows, a stencil, a grating element or piece; (b) the optical element having a predetermined optical texture, (c) the optical element having a variety or plurality of different-thicknesses, (d) a light source; or (e) at least one moving housing part, frame, bracket, compartment, container, ball part, or element, to allow light passing through to create said image moving effects, and wherein said device is a plug-in outdoor outlet device, an outdoor light device with a bulb base, a USB powered device, or a garden or outdoor light with a built-in or external AC-to-DC circuit connected to the power source.

* * * * *